US008963967B2

(12) United States Patent
Yoshinaga

(10) Patent No.: US 8,963,967 B2
(45) Date of Patent: Feb. 24, 2015

(54) DRIVE CIRCUIT, DISPLAY, AND METHOD OF DRIVING DISPLAY

(75) Inventor: Tomoro Yoshinaga, Kanagawa (JP)

(73) Assignee: Sony Corporation, Tokyo (JP)

( * ) Notice: Subject to any disclaimer, the term of this patent is extended or adjusted under 35 U.S.C. 154(b) by 173 days.

(21) Appl. No.: 13/567,669

(22) Filed: Aug. 6, 2012

(65) Prior Publication Data

US 2013/0050304 A1 Feb. 28, 2013

(30) Foreign Application Priority Data

Aug. 31, 2011 (JP) ..... 2011-189928

(51) Int. Cl.
*G09G 5/02* (2006.01)
*G09G 3/36* (2006.01)
*G09G 3/20* (2006.01)

(52) U.S. Cl.
CPC ..... *G09G 3/36* (2013.01); *G09G 3/2033* (2013.01); *G09G 2310/027* (2013.01); *G09G 2320/0209* (2013.01); *G09G 2320/0266* (2013.01)
USPC ..... 345/694

(58) Field of Classification Search
CPC ..... G09G 2310/027
See application file for complete search history.

(56) References Cited

U.S. PATENT DOCUMENTS 6,429,833 B1 * 8/2002 Ryeom et al. ..... 345/63
2002/0018029 A1 * 2/2002 Koyama ..... 345/39
2005/0259092 A1 * 11/2005 Aoki ..... 345/204
2011/0254759 A1 * 10/2011 Mori et al. ..... 345/88

FOREIGN PATENT DOCUMENTS

JP 2006-343609 12/2006

* cited by examiner

*Primary Examiner* — Srilakshmi K Kumar
*Assistant Examiner* — Carl Adams
(74) *Attorney, Agent, or Firm* — Rader, Fishman & Grauer PLLC

(57) ABSTRACT

A drive circuit includes: a division section that divides one frame period into a subfields, and divides each of one or more of the subfields to generate division subfields; a correction section that corrects, when bit arrays of the gray-scale data corresponding to respective two pixels next to each other are different from one another, the bit array of the gray-scale data corresponding to a first pixel of the two pixels to bring this bit array closer to the bit array of the gray-scale data corresponding to a second pixel of the two pixels, while maintaining gray-scale; and an ON-OFF-period control section that controls a ratio of an ON period or an OFF period to the one frame period, by turning on or off a liquid crystal cell of each of pixels according to the bit corresponding to each of the subfields and each of the division subfields.

15 Claims, 17 Drawing Sheets

DRIVE CIRCUIT, DISPLAY, AND METHOD OF DRIVING DISPLAY

BACKGROUND

The technology relates to a drive circuit that performs gray-scale display with pulse width modulation (PWM), and to a display having the drive circuit. The technology also relates to a method of driving the display.

When a case of five bits (32-level gray scale) is taken as an example, a gray-scale display method as illustrated in FIG. 22 according to a comparative example, for instance, is used in a digital-driving display that performs gray-scale display with PWM. Specifically, as illustrated in FIG. 22, five pieces of data in a 1:2:4:8:16 period ratio are prepared using data of one bit with a width of a few milliseconds as a unit, for instance. The 32-level gray scale is expressed by a combination of these five pieces of data.

Part (A) to Part (D) of FIG. 23 illustrate a relationship between signal data in sequential scanning and selection pulses applied to scanning lines, in typical digital driving according to a comparative example. Here, a case of using three scanning lines is illustrated for the sake of description. As apparent from Part (A) to Part (D) of FIG. 23, in a display of typical digital driving, one frame period (1F) is divided into subfields SF1 to SF5 corresponding to the respective bits (in this case, a first bit to a fifth bit) of gray-scale data. The subfields SF1 to SF5 are periods each depending on the weight of the corresponding bit. The ratio of an ON period or an OFF period to the 1F is controlled stepwise, by turning an electro-optical device of a pixel on or off in accordance with the bit corresponding to each of the subfields SF1 to SF5. Writing data to the pixel through the scanning line is performed in line-sequential scanning, for each of the subfields SF1 to SF5. It is to be noted that information about the digital driving is described in, for example, Japanese Unexamined Patent Application Publication No. 2006-343609.

SUMMARY

When a gray-scale display method in which a black/white-phase inversion occurs due to a slight difference in gray-scale is used as illustrated in FIG. 22 according to a comparative example, a liquid crystal disorder may take place between pixels next to each other because of a transverse electric field. For example, as illustrated in Part (A) and Part (B) of FIG. 24, when an image having gradation in a vertical direction (which will be hereinafter simply referred to as "gradation image") is displayed, a liquid crystal disorder occurs between pixels each having an inverted black or white phase. This liquid crystal disorder is visually recognized by a viewer, as a black streak L1 illustrated in Part (B) of FIG. 24, for example. This black streak L1 significantly impairs image quality.

It is desirable to provide a drive circuit resistant to occurrence of a liquid crystal disorder, and a display having this drive circuit. It is also desirable to provide a method of driving a display resistant to occurrence of a liquid crystal disorder.

According to an embodiment of the technology, there is provided a drive circuit driving each of pixels that are arranged in matrix in a display, in which each of the pixels is provided with a built-in memory that includes a liquid crystal cell. The drive circuit includes: a division section dividing one frame period into a plurality of subfields, and dividing each of one or more of the plurality of subfields to generate a plurality of division subfields, each of the plurality of subfields corresponding to each bit of gray-scale data and having a period corresponding to a weight of the corresponding bit, and each of the one or more of the plurality of subfields having the period that is relatively long and being divided into periods each equal to the period of the subfield that is relatively short; a correction section correcting, when bit arrays of the gray-scale data corresponding to the respective two pixels next to each other are different from one another, the bit array of the gray-scale data corresponding to a first pixel of the two pixels to bring this bit array closer to the bit array of the gray-scale data corresponding to a second pixel of the two pixels, while maintaining gray-scale; and an ON-OFF-period control section controlling a ratio of an ON period or an OFF period to the one frame period, by turning on or off the liquid crystal cell of each of the pixels according to the bit corresponding to each of the subfields and each of the division subfields.

According to an embodiment of the technology, there is provided a display with a display region and a drive circuit, in which the display region is provided with pixels that are arranged in matrix and each having a built-in memory that includes a liquid crystal cell, and the drive circuit drives each of the pixels. The drive circuit includes: a division section dividing one frame period into a plurality of subfields, and dividing each of one or more of the plurality of subfields to generate a plurality of division subfields, each of the plurality of subfields corresponding to each bit of gray-scale data and having a period corresponding to a weight of the corresponding bit, and each of the one or more of the plurality of subfields having the period that is relatively long and being divided into periods each equal to the period of the subfield that is relatively short; a correction section correcting, when bit arrays of the gray-scale data corresponding to the respective two pixels next to each other are different from one another, the bit array of the gray-scale data corresponding to a first pixel of the two pixels to bring this bit array closer to the bit array of the gray-scale data corresponding to a second pixel of the two pixels, while maintaining gray-scale; and an ON-OFF-period control section controlling a ratio of an ON period or an OFF period to the one frame period, by turning on or off the liquid crystal cell of each of the pixels according to the bit corresponding to each of the subfields and each of the division subfields.

According to an embodiment of the technology, there is provided a method of driving a display, in which the display is provided with pixels that are arranged in matrix and each having a built-in memory that includes a liquid crystal cell. The method includes: dividing one frame period into a plurality of subfields, and dividing each of one or more of the plurality of subfields to generate a plurality of division subfields, each of the plurality of subfields corresponding to each bit of gray-scale data and having a period corresponding to a weight of the corresponding bit, and each of the one or more of the plurality of subfields having the period that is relatively long and being divided into periods each equal to the period of the subfield that is relatively short; correcting, when bit arrays of the gray-scale data corresponding to the respective two pixels next to each other are different from one another, the bit array of the gray-scale data corresponding to a first pixel of the two pixels to bring this bit array closer to the bit array of the gray-scale data corresponding to a second pixel of the two pixels, while maintaining gray-scale; and controlling a ratio of an ON period or an OFF period to the one frame period, by turning on or off the liquid crystal cell of each of the pixels according to the bit corresponding to each of the subfields and each of the division subfields.

In the drive circuit, the display, and the method of driving the display according to the above-described embodiments of the technology, each of the one or more of the plurality of subfields having the period that is relatively long is divided into the periods each equal to the period of the subfield having the period that is relatively short. Further, when the bit arrays of gray-scale data corresponding to the respective two pixels next to each other are different, the bit array of the gray-scale data corresponding to the first pixel of the two pixels is brought closer to the bit array of the gray-scale data corresponding to the second pixel of the two pixels, while the gray-scale is maintained. This allows a reduction in the ratio of a part where the bit arrays of gray-scale data corresponding to the respective two pixels next to each other are different.

According to the drive circuit, the display, and the method of driving the display in the above-described embodiments of the technology, there is a reduction in the ratio of the part where the bit arrays of gray-scale data corresponding to the respective two pixels next to each other are different. Thus, a liquid crystal disorder is less likely to occur. As a result, high image quality is allowed to be achieved.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

Figure 2:
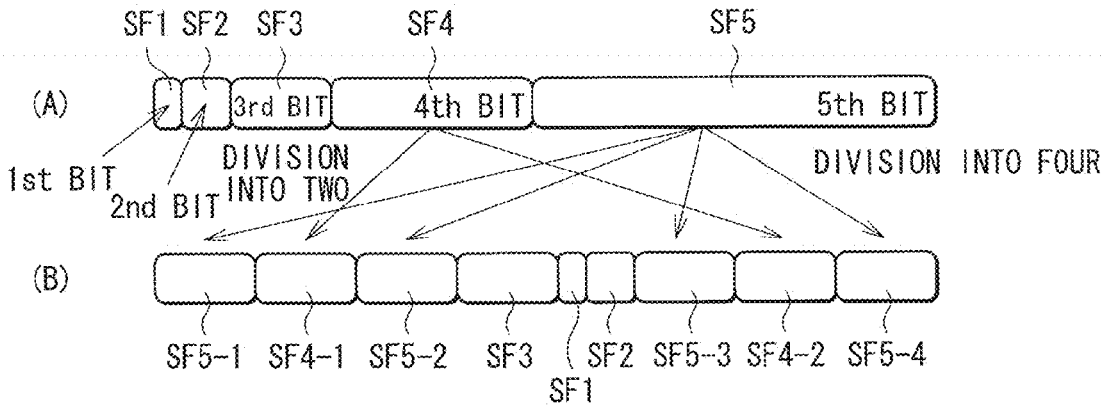

Part (A) and Part (B) of FIG. 2 are schematic diagrams illustrating an example of signal data defined by subfields.

Figure 3:
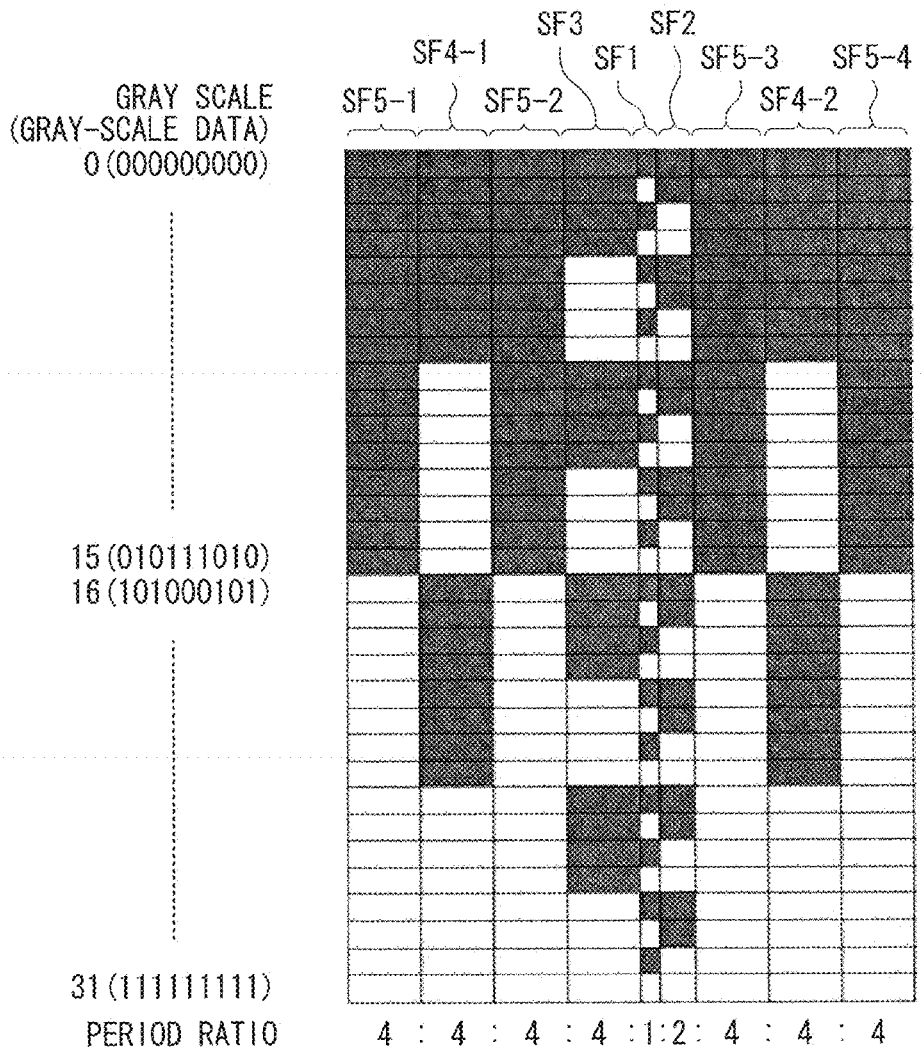

FIG. 3 is a schematic diagram illustrating an example of gray-scale data.

Figure 4:
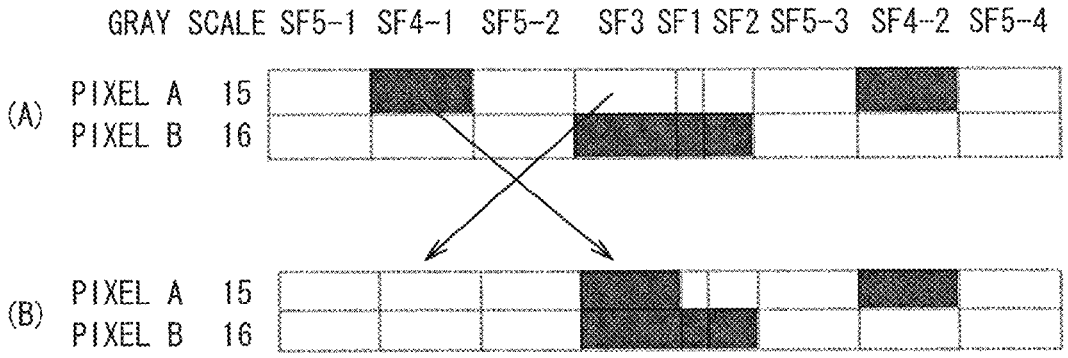

Part (A) and Part (B) of FIG. 4 are schematic diagrams illustrating an example of correction of gray-scale data when a gray-scale display method in FIG. 3 is used.

Figure 5:
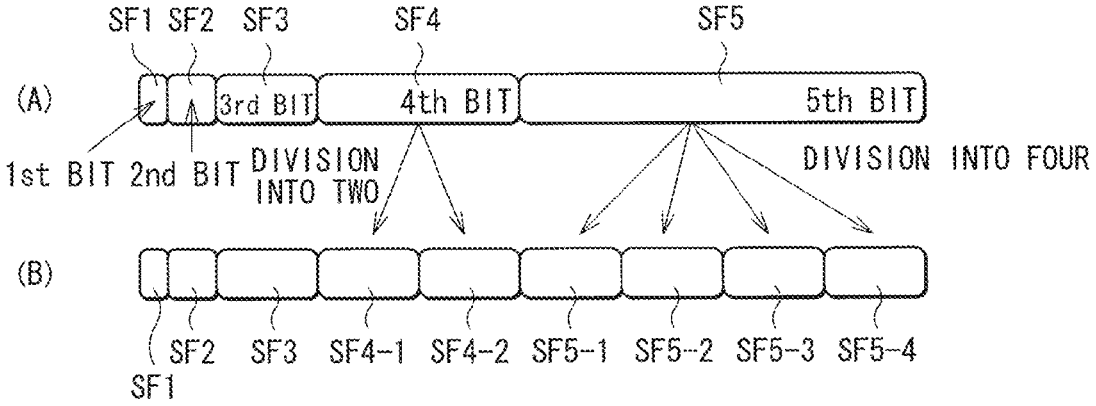

Part (A) and Part (B) of FIG. 5 are schematic diagrams illustrating another example of the signal data defined by subfields.

Figure 6:
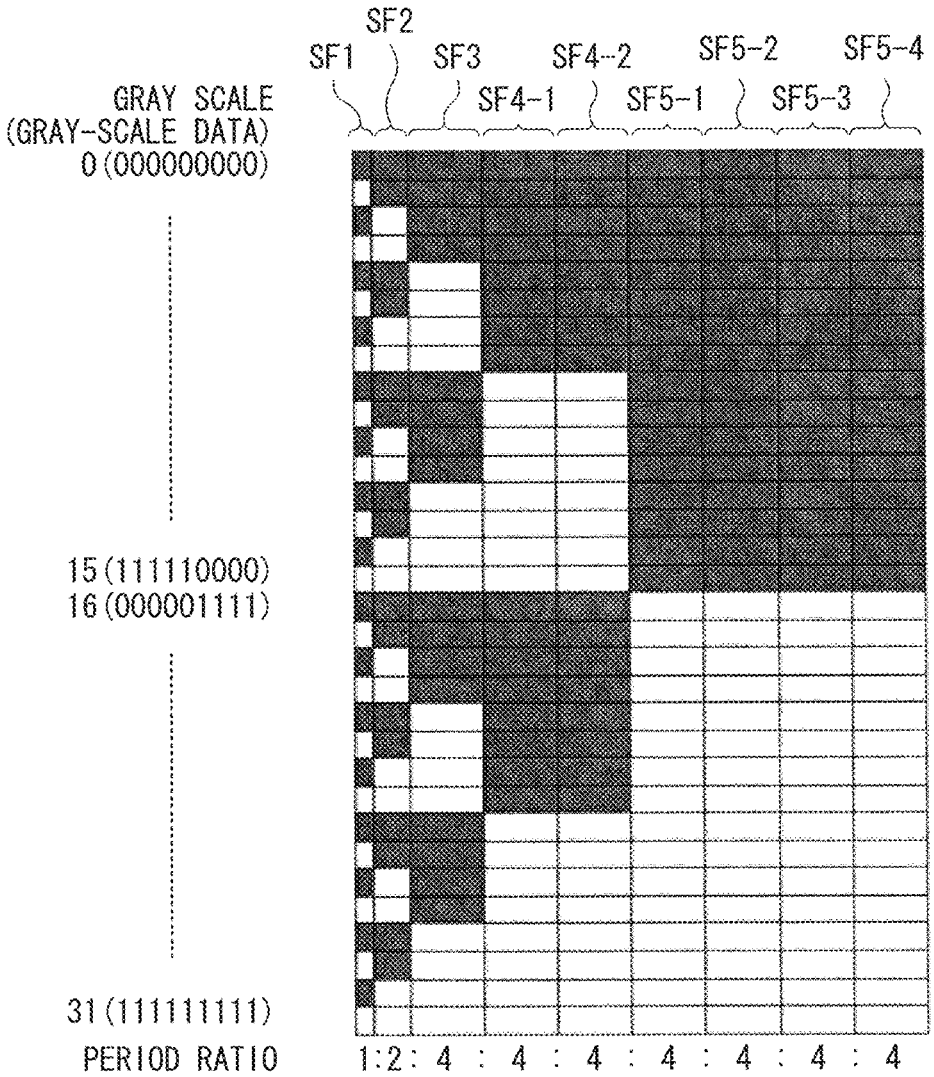

FIG. 6 is a schematic diagram illustrating another example of the gray-scale data.

Figure 7:
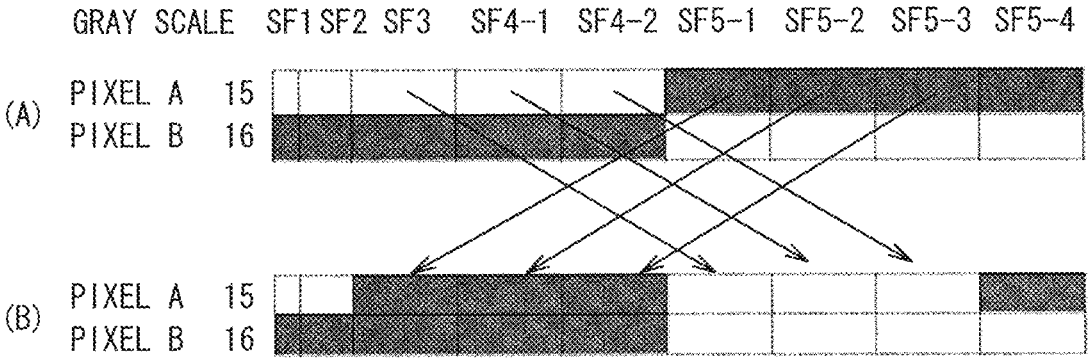

Part (A) and Part (B) of FIG. 7 are schematic diagrams illustrating an example of correction of gray-scale data when a gray-scale display method in FIG. 6 is used.

Figure 8:
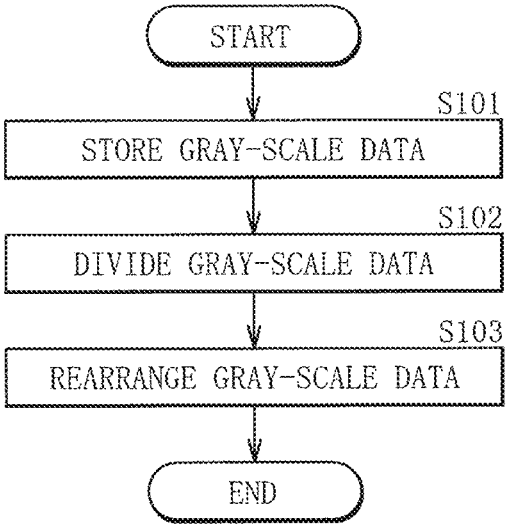

FIG. 8 is a flowchart illustrating an example of a procedure in which the correction in Part (A) and Part (B) of FIG. 4 or Part (A) and Part (B) of FIG. 7 is readily performed.

Figure 9:
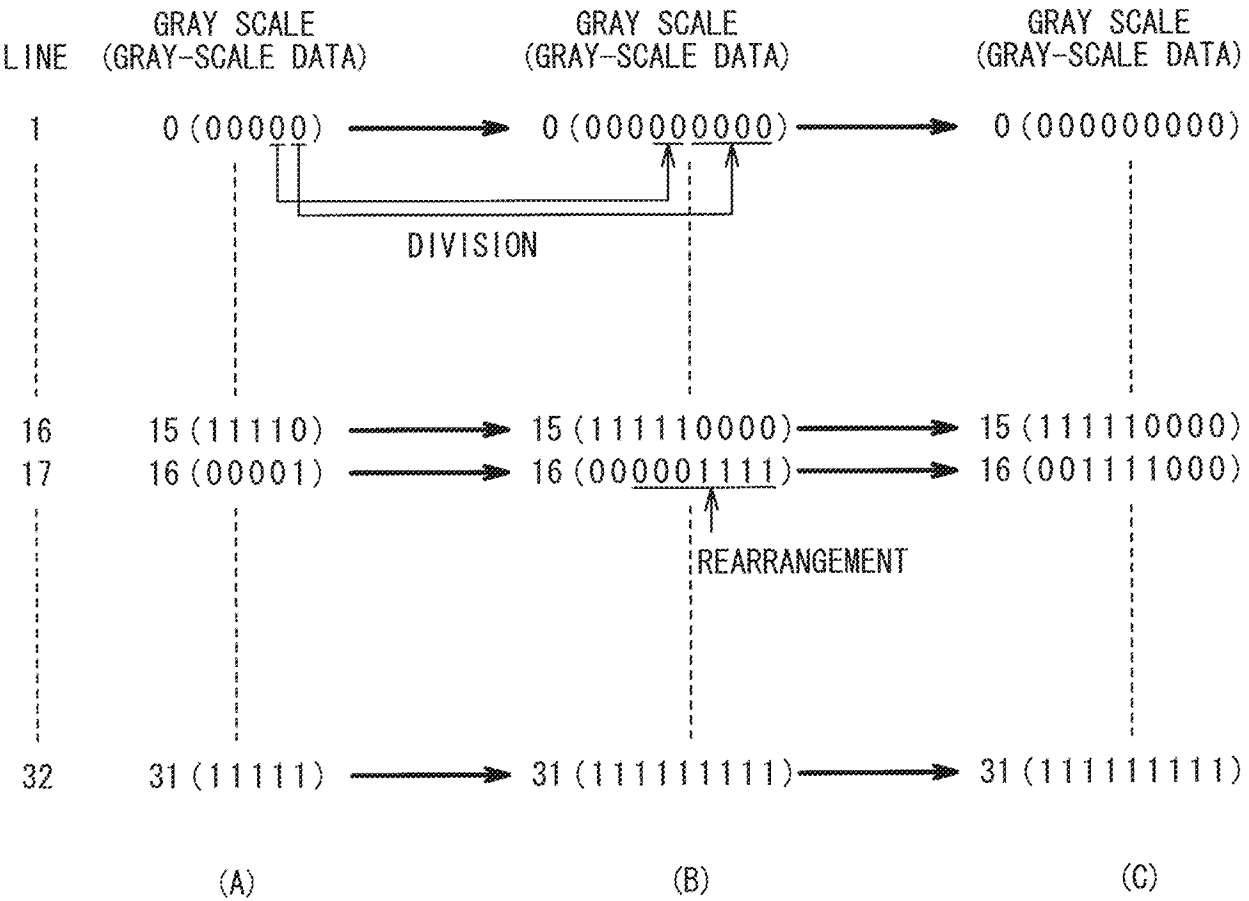

Part (A) to Part (C) of FIG. 9 are diagrams illustrating the example of the procedure of the correction in FIG. 8, in form of bits.

Figure 10:
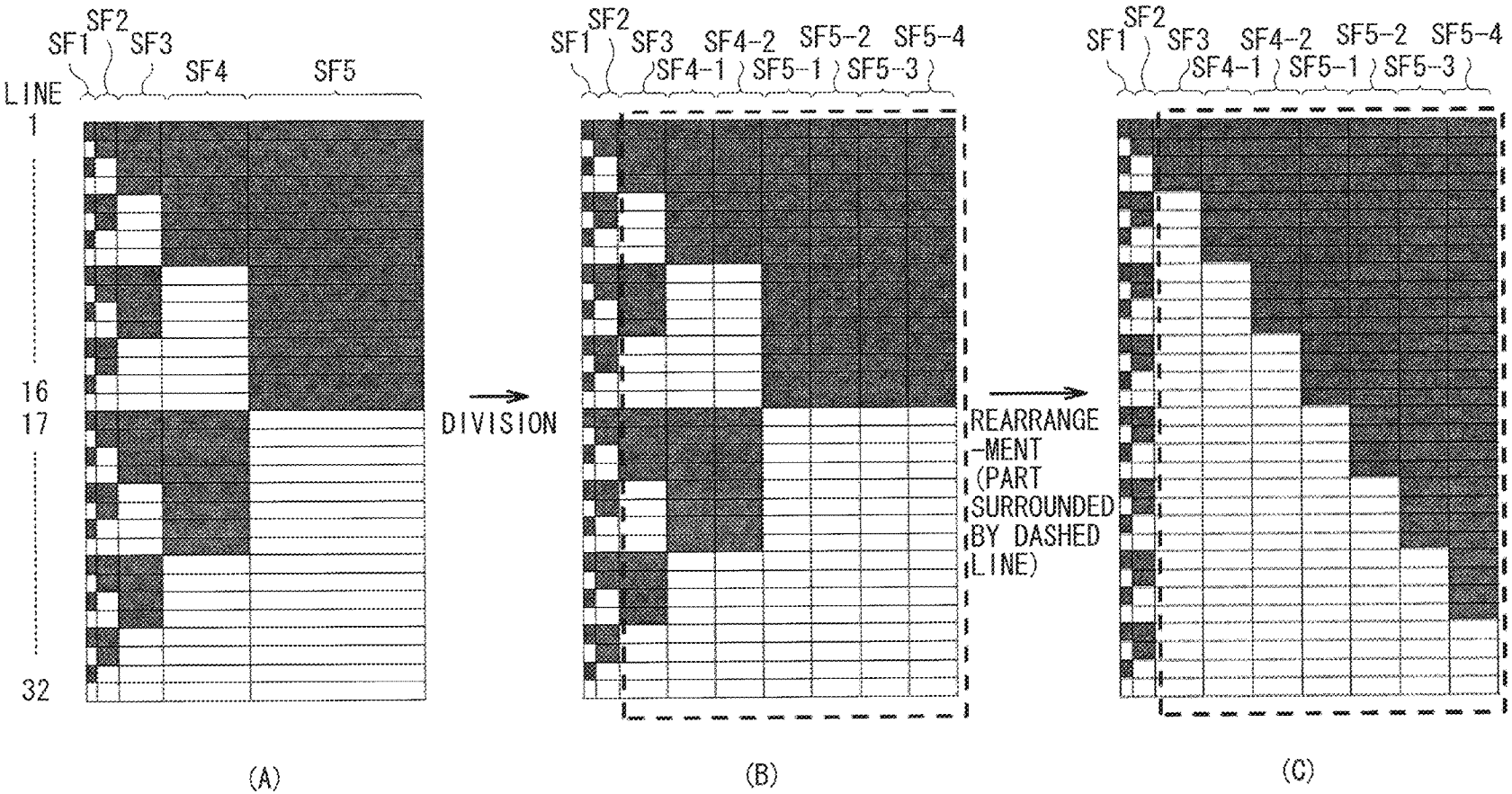

Part (A) to Part (C) of FIG. 10 are diagrams illustrating the bits in Part (A) to Part (C) of FIG. 9, in form of black and white.

Figure 11:
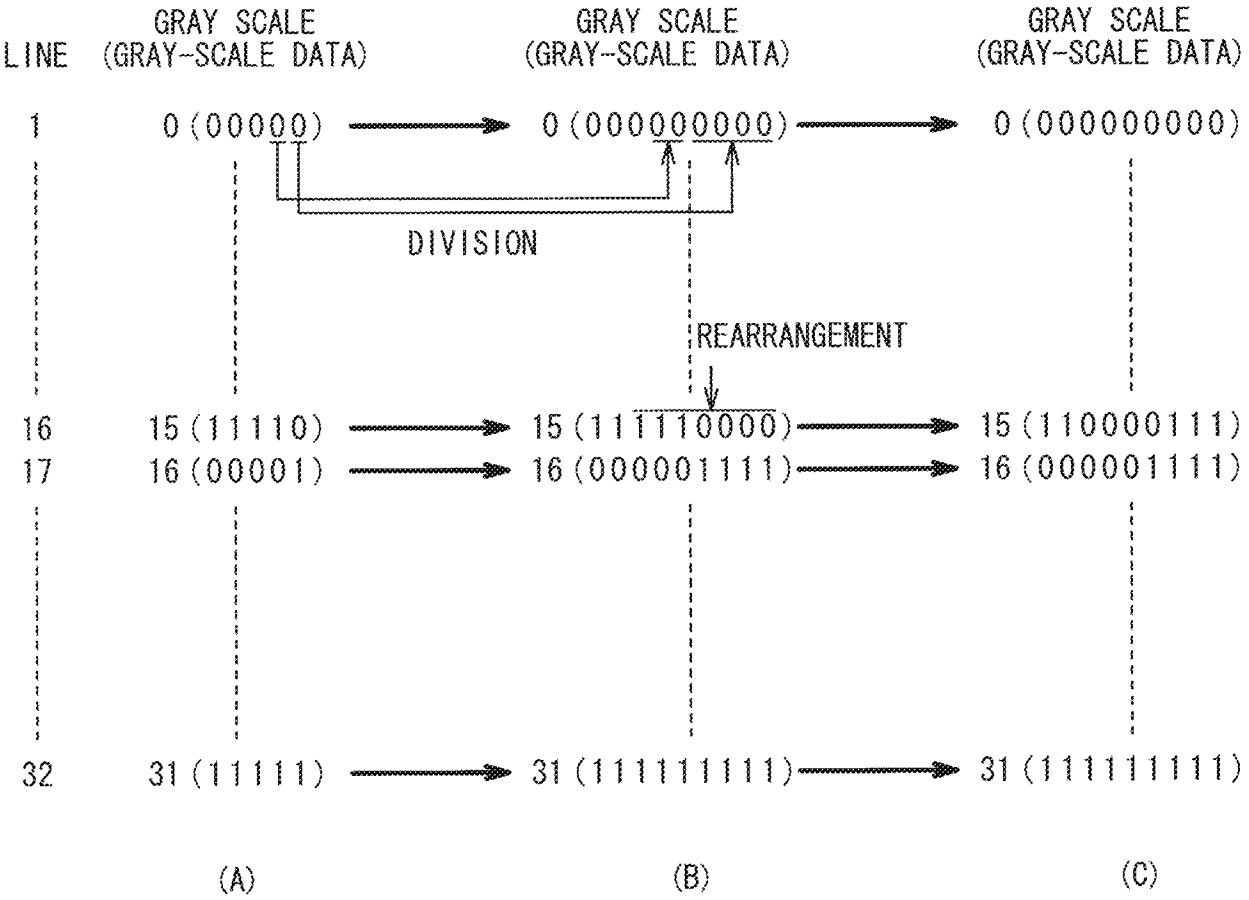

Part (A) to Part (C) of FIG. 11 are diagrams illustrating another example of the procedure of the correction in FIG. 8, in form of bits.

Figure 12:
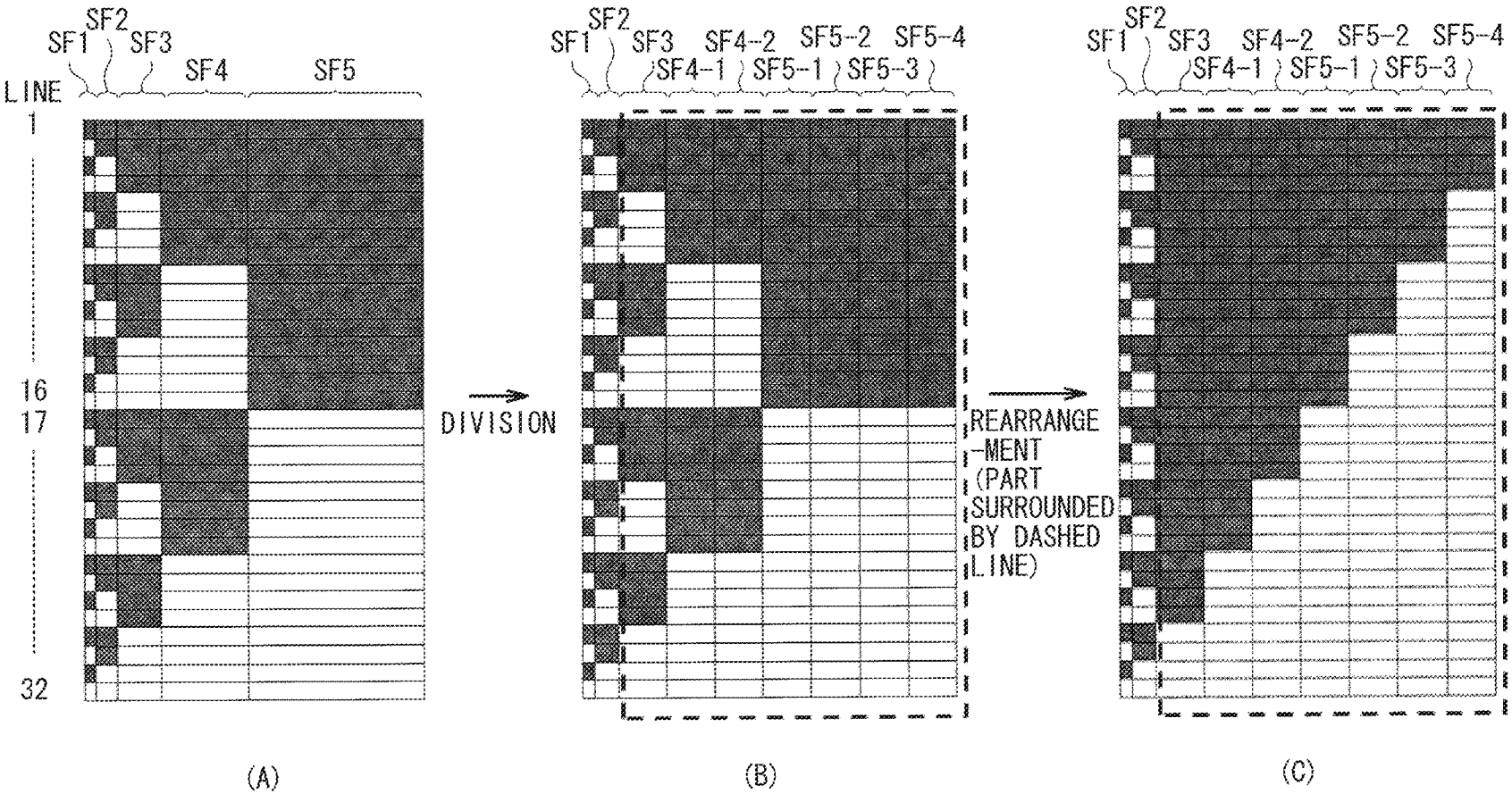

Part (A) to Part (C) of FIG. 12 are diagrams illustrating the bits in Part (A) to Part (C) of FIG. 11, in form of black and white.

Figure 13:
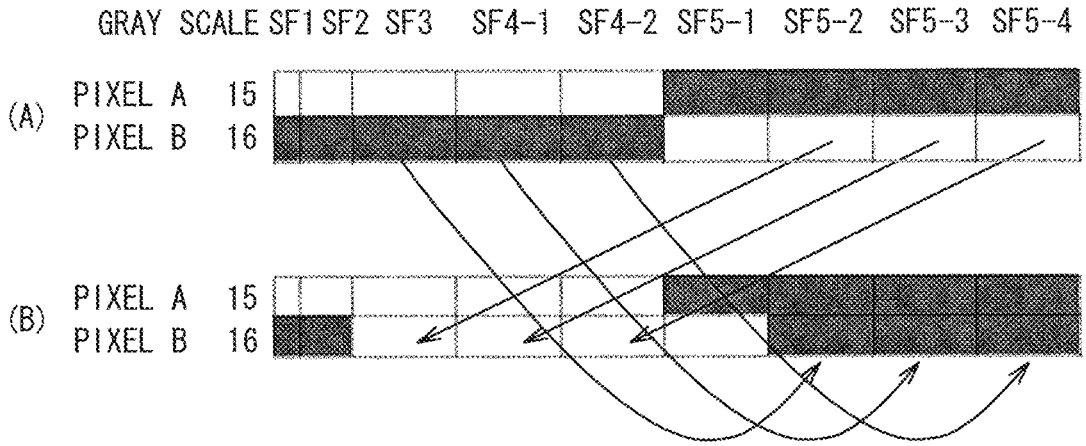

Part (A) and Part (B) of FIG. 13 are schematic diagrams illustrating an example of a change in gray-scale data when the correction in FIG. 8 to Part (C) of FIG. 10 is performed.

Figure 14:
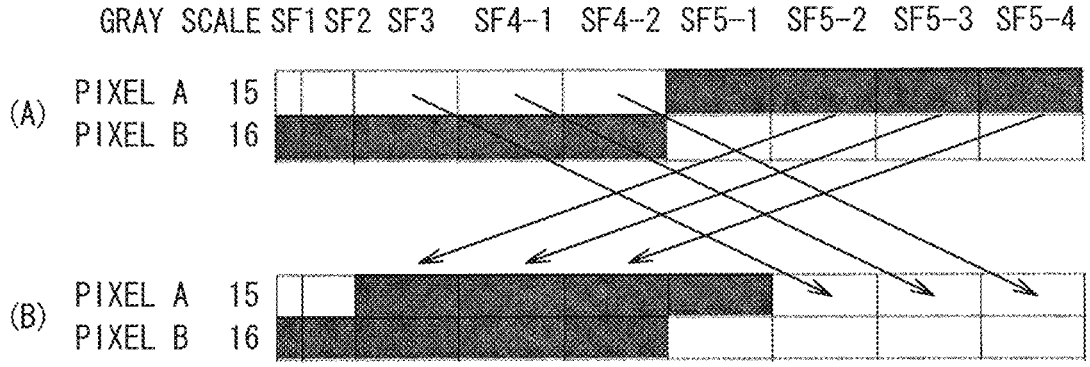

Part (A) and Part (B) of FIG. 14 are schematic diagrams illustrating an example of a change in gray-scale data when the correction in FIG. 8, Part (A) to Part (C) of FIG. 11, and Part (A) to Part (C) of FIG. 12 is performed.

Figure 1:
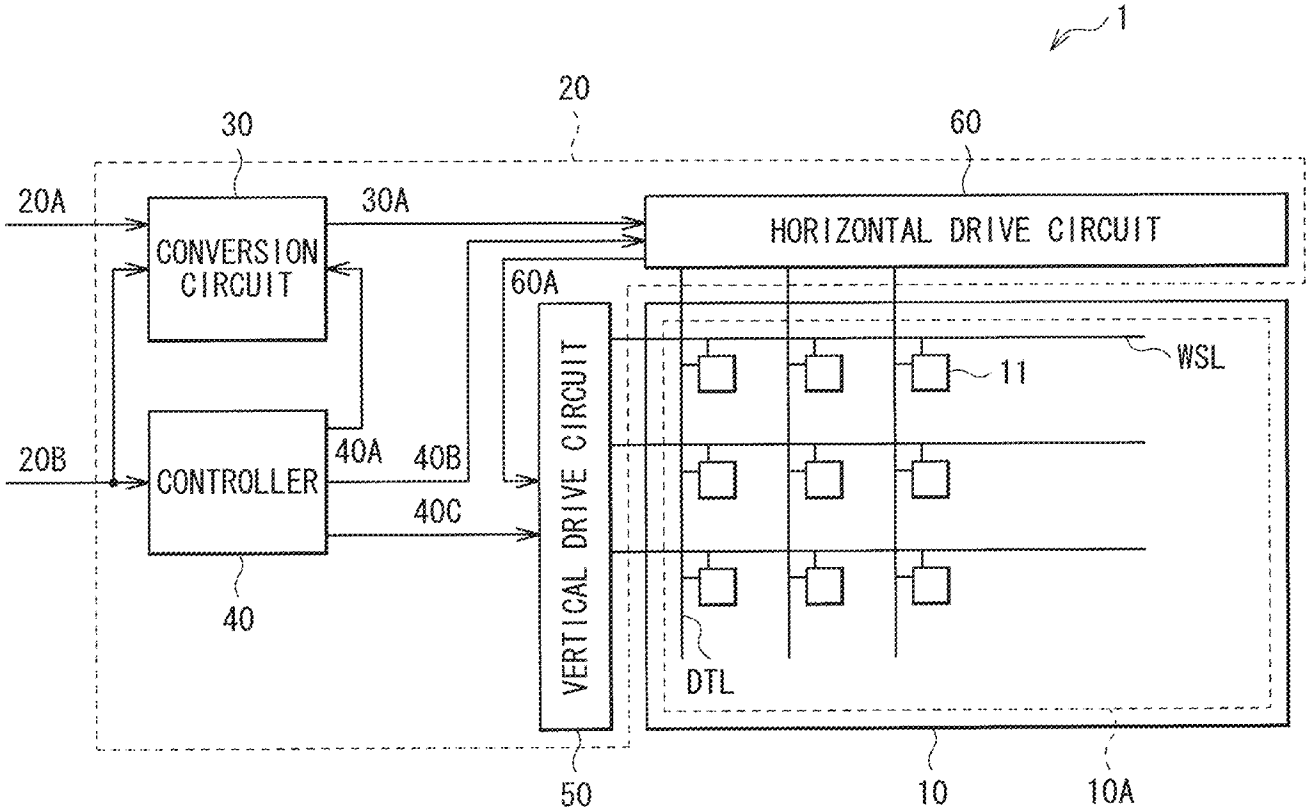
FIG. 1 is a schematic diagram of a display according to an embodiment of the technology.
Figure 15:
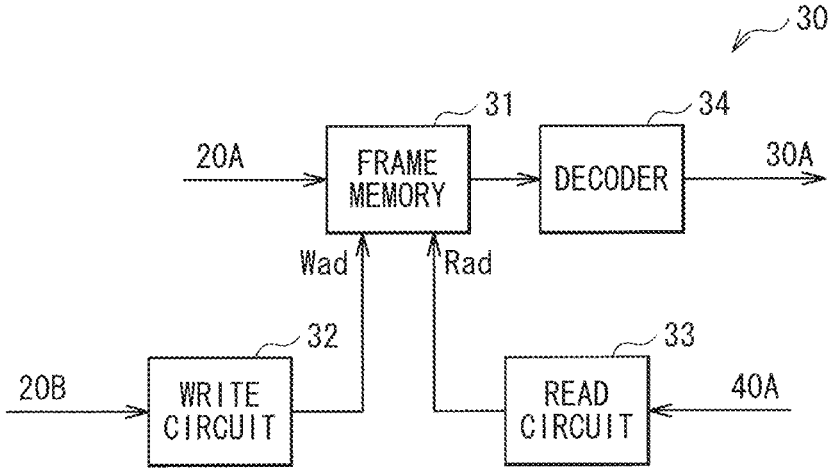

FIG. 15 is a schematic diagram of a conversion circuit in FIG. 1.

Figure 16:
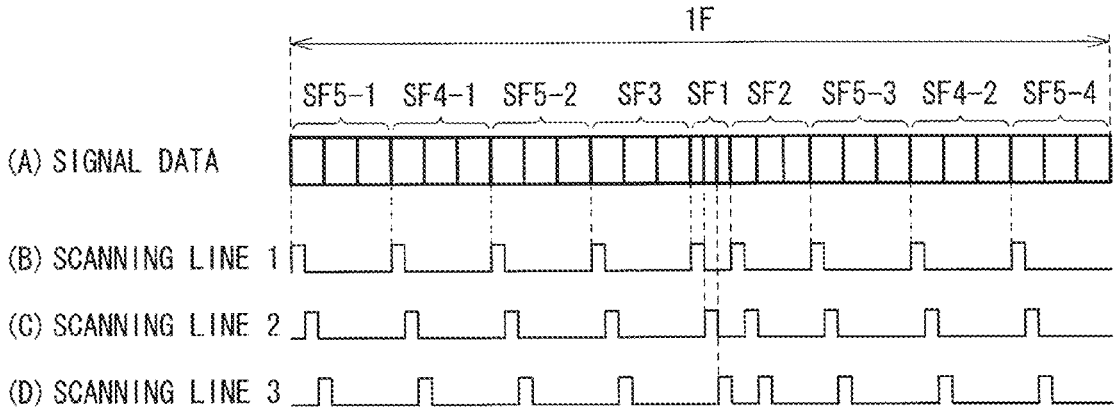

Part (A) to Part (D) of FIG. 16 are schematic diagrams illustrating an example of signal data and examples of a selection pulse, in one frame period.

Figure 17:
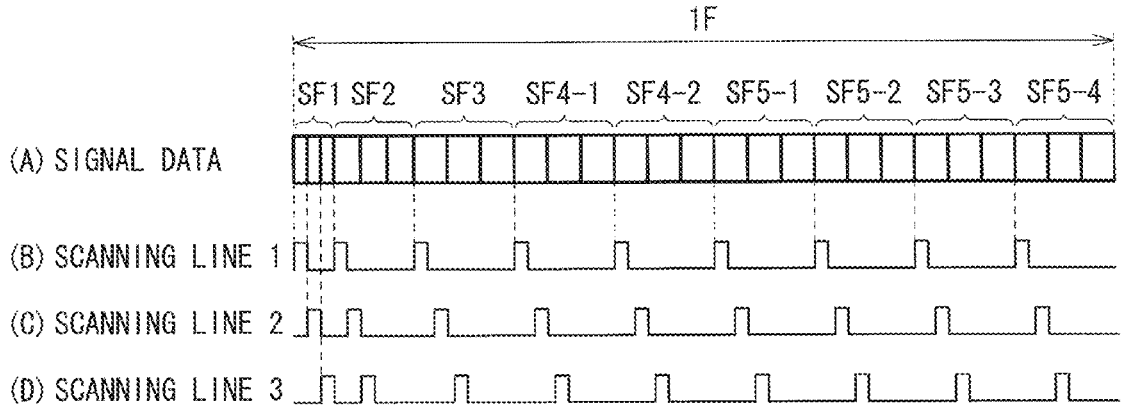

Part (A) to Part (D) of FIG. 17 are schematic diagrams illustrating another example of the signal data and other examples of the selection pulse, in one frame period.

Figure 18:
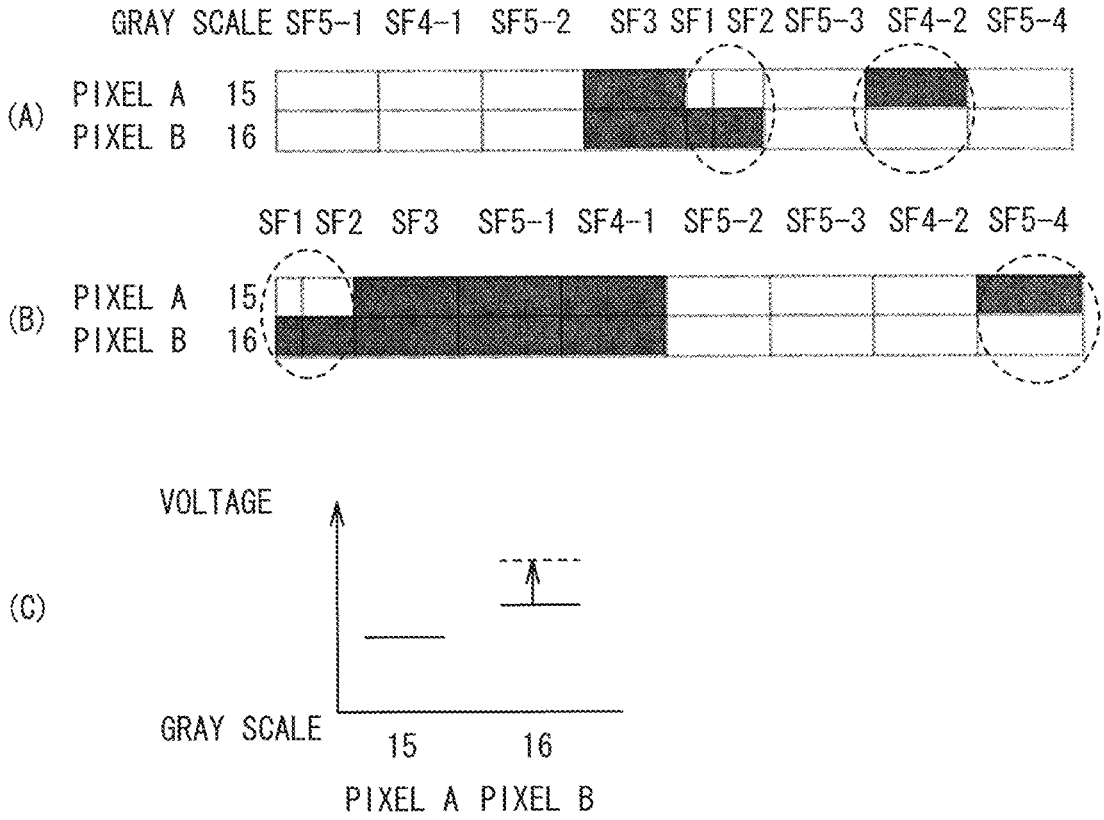

Part (A) to Part (C) of FIG. 18 are schematic diagrams illustrating an example of the gray-scale data after the above-described correction, and an example of correction of the gray-scale data after the above-described correction.

Figure 19:
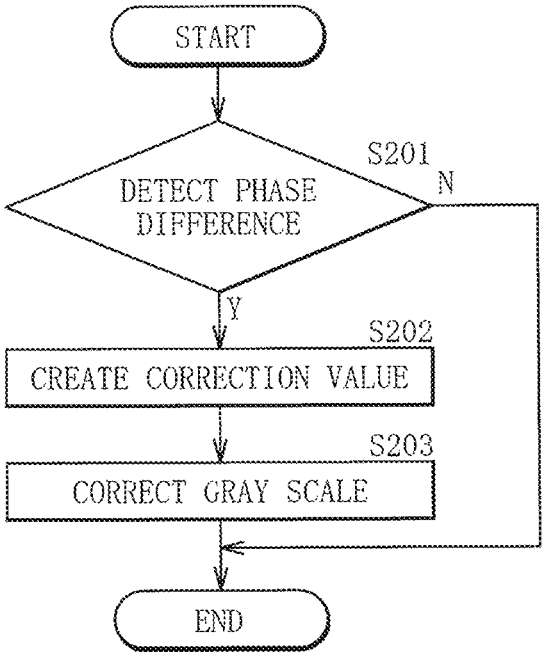

FIG. 19 is a flowchart illustrating an example of a procedure of the correction in Part (C) of FIG. 18.

Figure 20:
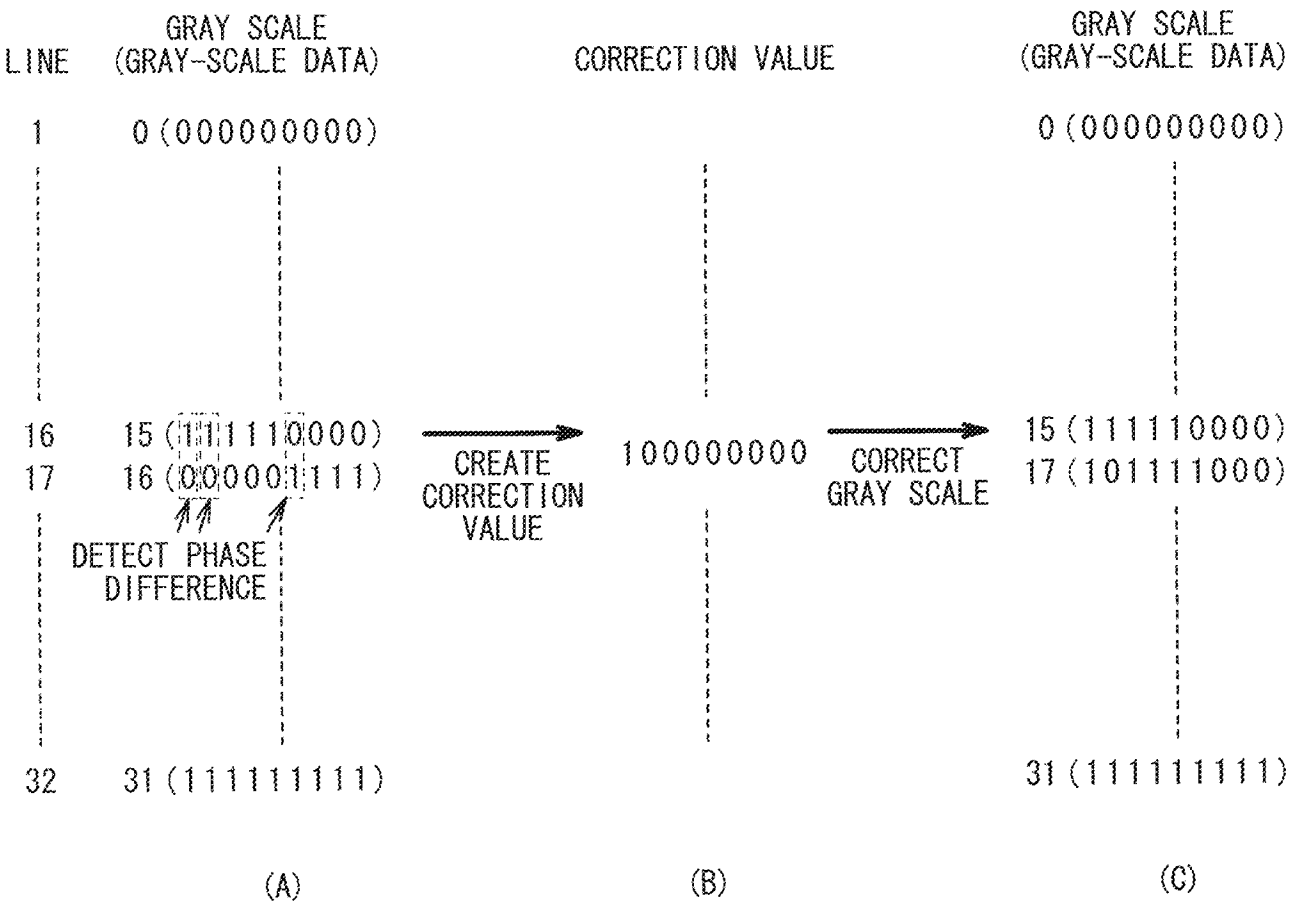

Part (A) to Part (C) of FIG. 20 are diagrams illustrating an example of a procedure of the correction in FIG. 19, in form of bits.

Figure 21:
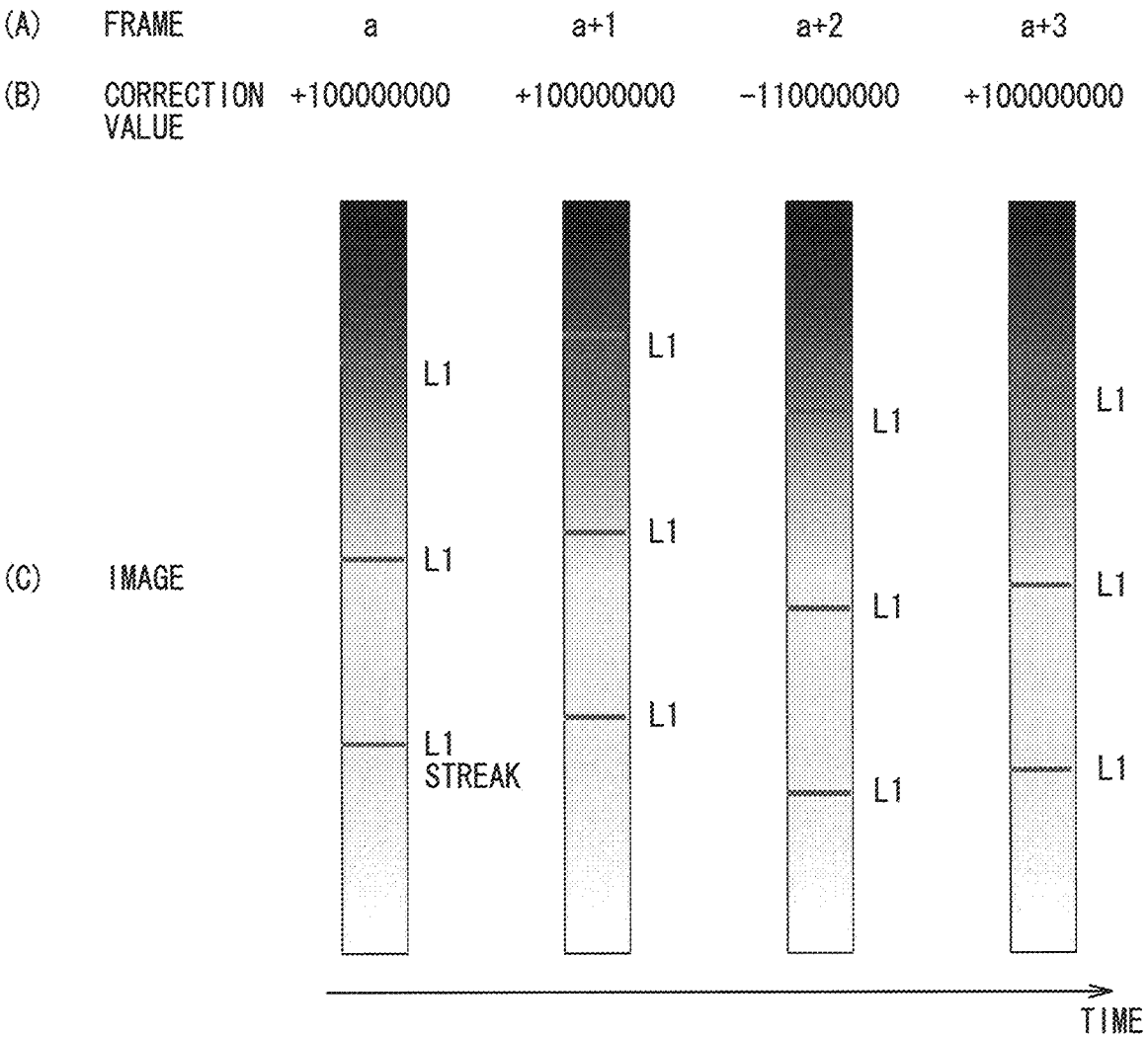

Part (A) to Part (C) of FIG. 21 are schematic diagrams used to describe another correction in the embodiment or a modification thereof.

Figure 22:
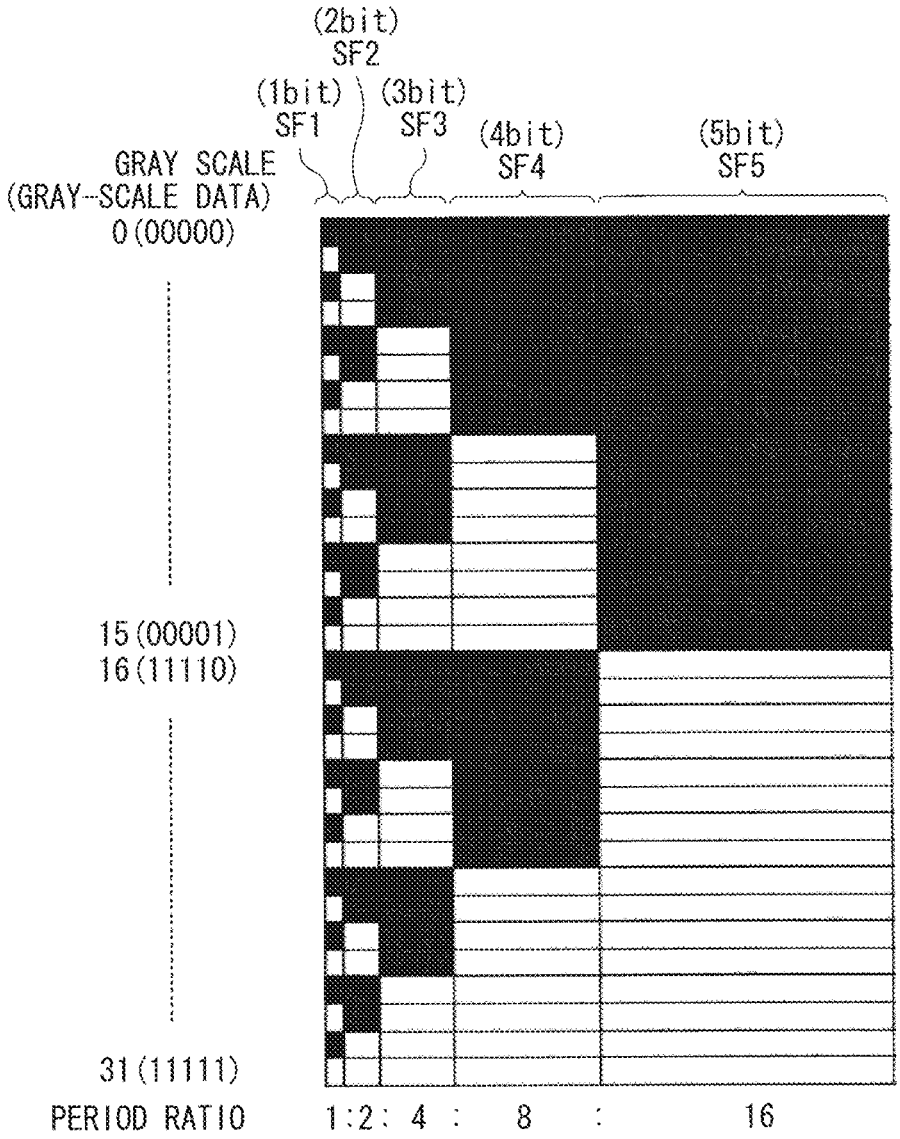

FIG. 22 is a schematic diagram illustrating an example of gray-scale data according to a comparative example.

Figure 23:
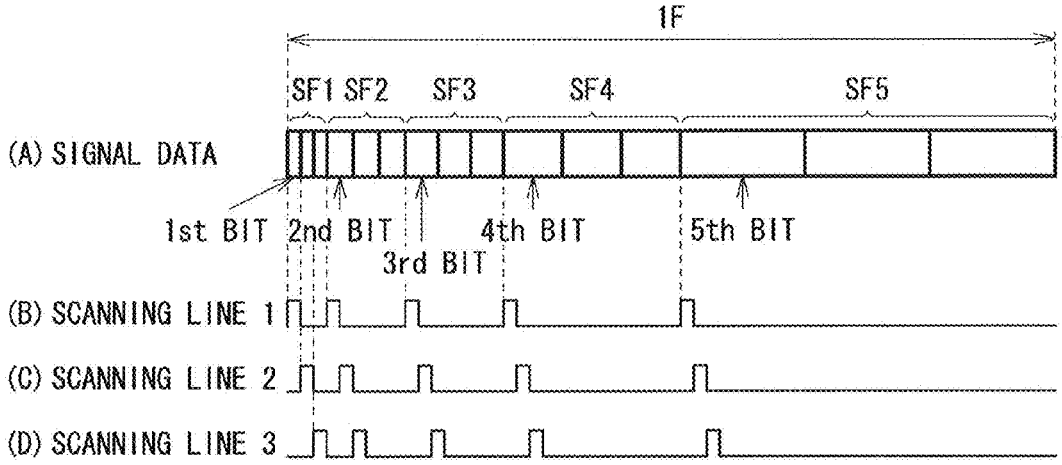

Part (A) to Part (D) of FIG. 23 are schematic diagrams illustrating a typical example of signal data and typical examples of a selection pulse, in one frame period according to a comparative example.

Figure 24:
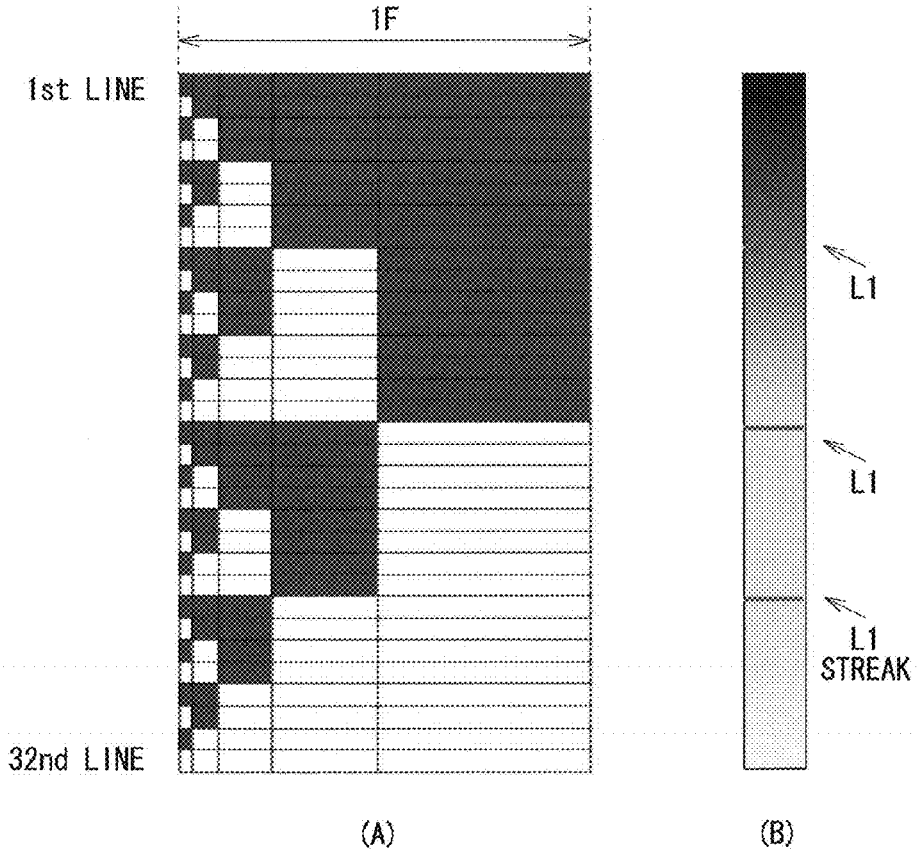

Part (A) and Part (B) of FIG. 24 are schematic diagrams illustrating an example of a streak generated in a gradation image.

DETAILED DESCRIPTION

An embodiment of the technology will be described below in detail with reference to the drawings. It is to be noted that the description will be provided in the following order.

1. Embodiment (a display)
2. Modifications (displays)

1. EMBODIMENT

Configuration

FIG. 1 illustrates a schematic configuration of a display 1 according to an embodiment of the technology. This display 1 includes a display panel 10 and a peripheral circuit 20 driving the display panel 10.

(Display Panel 10)

The display panel 10 includes a plurality of scanning lines WSL extending in a row direction, and a plurality of data lines DTL extending in a column direction. The display panel 10 further includes a plurality of pixels 11 each corresponding to an intersection of each of the scanning lines WSL and each of the data lines DTL. The plurality of pixels 11 in the display panel 10 are two-dimensionally arranged in the row direction and the column direction, all over a pixel region 10A of the display panel 10. The pixel 11 corresponds to a point that is a minimum unit of a screen on the display panel 10. When the display panel 10 is a color display panel, the pixel 11 is equivalent to, for example, a subpixel that emits light of single color such as red, green, or blue. When the display panel 10 is a monochrome display panel, the pixel 11 is equivalent to a pixel that emits monochromatic light (e.g., white light).

The pixel 11 is a pixel with a built-in memory including an electro-optical device, although not illustrated. One type of the electro-optical device is a liquid crystal cell. Examples of the type of the memory include SRAM (Static Random Access Memory) and DRAM (Dynamic Random Access Memory). When corresponding one of the scanning lines WSL is selected, the pixel 11 enters an emission state or an extinction state in response to writing of signal data (bit) supplied to the corresponding data line DTL. Even when this scanning line WSL is not selected anymore afterwards, the emission state or the extinction state based on the writing continues. Therefore, the peripheral circuit 20 achieves gray-scale display, by controlling the ratio of a period during which the pixel 11 is in the emission state (i.e. a lighted period) or a period during which the pixel 11 is in the extinction state (i.e. an extinguished period), to one frame period.

There is a concept called "subfield" serving as a unit of the lighted period or the extinguished period of the pixel 11. The "subfield" corresponds to each bit of gray-scale data defining gray-scale of the pixel 11, and indicates a unit of a period depending on the weight of the corresponding bit. For example, when 32-level gray scale is expressed by 5-bit gray-scale data, as illustrated in FIG. 22 according to a comparative example, for instance, five pieces of data in a 1:2:4:8:16 period ratio are prepared using, for example, data of one bit having a width of a few milliseconds, as a unit. The 32-level gray scale is expressed by a combination of these five pieces of data. In this gray-scale display method, as illustrated in Part (A) of FIG. 2, signal data is defined by subfields SF1 to SF5 corresponding to the respective bits (a first bit to a fifth bit) of the gray-scale data. Each of the subfields SF1 to SF5 serves as a period depending on the weight of the corresponding bit.

In the present embodiment, further, "division subfield" is applied to a subfield with a relatively-long period (i.e. on a high gray-scale side), as a unit of the lighted period or the extinguished period of the pixel 11. The "division subfield" indicates a fragment subfield, which is generated by dividing a subfield with a relatively-long period into periods each equal to the period of a subfield with a relatively-short period. For example, as illustrated in Part (B) of FIG. 2, the subfields SF4 and SF5 corresponding to the fourth bit and the fifth bit of the gray-scale data, respectively, are divided into periods each equal to the period of the subfield SF3. The period of the subfield SF3 is relatively shorter than the subfield SF4. As a result, two division subfields SF4-1 and SF4-2 are generated from the subfield SF4, and four division subfields SF5-1, SF5-2, SF5-3, and SF5-4 are generated from the subfield SF5. The period of each of the division subfields SF4-1, SF4-2, SF5-1, SF5-2, SF5-3, and SF5-4 is longer than the period of each of the subfields SF1 and SF2 on a low gray-scale side, and is the longest period in the signal data.

Here, the bit corresponding to the division subfield is equal to the bit corresponding to the subfield that is a source of the division resulting in the division subfield. For example, the bit corresponding to each of the division subfields SF4-1 and SF4-2 is equal to the bit corresponding to the subfield SF4. Similarly, the bit corresponding to each of the division subfields SF5-1, SF5-2, SF5-3, and SF5-4 is equal to the bit corresponding to the subfield SF5. In the present embodiment, when gray-scale data with 32-level gray scale expressed by five bits (see FIG. 22) is inputted, for example, nine pieces of data in a 4:4:4:4:1:2:4:4:4 period ratio are prepared using, for example, data of one bit having a width of a few milliseconds, as a unit, as illustrated in FIG. 3, for instance. The 32-level gray scale is expressed by a combination of these nine pieces of data. In this case, the second period and the eighth period from the lead correspond to the division subfields SF4-1 and SF4-2, respectively. In addition, the first period, the third period, the seventh period, and the ninth period from the lead correspond to the division subfields SF5-1, SF5-2, SF5-3, and SF5-4, respectively. In this gray-scale display method, there is a reduction in a degree to which a border between black and white stays for a long time due to a slight difference in gray-scale between two pixels next to each other, in comparison with the gray-scale display method illustrated in FIG. 22.

In the gray-scale display method described above, at least a part of (one or more of) the division subfields are each placed in a section different from that before the division, in the one frame period. Further, the division subfields are placed so that the subfields as a source of the division, each divided into the division subfields next to each other, are different from each other. For example, as illustrated in Part (B) of FIG. 2, the division subfield SF4-1 generated from the subfield SF4 is placed next to the division subfields SF5-1 and SF5-2 generated from the subfield SF5. Further, the division subfield SF4-2 generated from the subfield SF4 is placed next to the division subfields SF5-3 and SF5-4 generated from the subfield SF5. Similarly, the division subfield SF5-1 generated from the subfield SF5 is placed at the lead of the signal data, and also placed next to the division subfield SF4-1 generated from the subfield SF4. Further, the division subfield SF5-2 generated from the subfield SF5 is placed next to the division subfield SF4-1 generated from the subfield SF4 and also to the subfield SF3 which is not divided. Furthermore, the division subfield SF5-3 generated from the subfield SF5 is placed next to the division subfield SF4-2 generated from the subfield SF4 and also to the subfield SF2 which is not divided. The division subfield SF5-4 generated from the subfield SF5 is placed at the tail of the signal data, and also placed next to the division subfield SF4-2 generated from the subfield SF4.

It is preferable that a part of the division subfields be placed closer to the beginning of the one frame period. For example, as illustrated in Part (B) of FIG. 2, the division subfield SF5-1 generated from the subfield SF5 is placed at the lead of the one frame period (the signal data). Further, for example, the division subfield SF4-1 generated from the subfield SF4 is placed at the second position from the lead of the one frame period (the signal data) as illustrated in Part (B) of FIG. 2.

The subfields and the division subfields in 1F are rearranged according to a predetermined rule. Specifically, when bit arrays of gray-scale data, which correspond to the respective two pixels 11 next to each other, are different from each other, the bit array of the gray-scale data corresponding to one of the pixels 11 is corrected to become closer to that corresponding to the other of the pixels 11, while maintaining the gray-scale.

For example, suppose signal data is defined in an order of SF5-1, SF4-1, SF5-2, SF3, SF1, SF2, SF5-3, SF4-2, and SF5-4, sequentially from the lead, as illustrated in Part (A) of FIG. 4. Further, suppose, when gray-scale corresponding to a pixel A is 15 and gray-scale corresponding to a pixel B next to the pixel A is 16, gray-scale data corresponding to each of the pixel A and the pixel B is defined according to the gray-scale display method in FIG. 3. Here, in each of the subfields SF4-1 and SF3, the phase (black or white phase) of the bit of the pixel A is different from that of the pixel B. Specifically, in the subfield SF4-1, the bit of the pixel A is 0 (black), whereas the bit of the pixel B is 1 (white). Further, in the subfield SF3, the bit of the pixel A is 1 (white), whereas the bit of the pixel B is 0 (black).

In this way, when the phase of each bit of the gray-scale data corresponding to the one of the two pixels 11 next to each other is different from that corresponding to the other, the bit array of the gray-scale data corresponding to the pixel A is corrected to become closer to the bit array of the gray-scale data corresponding to the pixel B. For example, as illustrated in Part (B) of FIG. 4, in the bit array of the gray-scale data corresponding to the pixel A, the bit corresponding to the subfield SF4-1 and the bit corresponding to the subfield SF3 having the same period as the bit corresponding to the subfield SF4-1 are replaced with each other. Thus, in each of the subfields SF4-1 and SF3, the phase (the black or white phase) of the bit of the pixel A and that of the pixel B become equal to each other. As a result, the bit array of the gray-scale data corresponding to the pixel A is allowed to become closer to the bit array of the gray-scale data corresponding to the pixel B, while maintaining the gray-scale of the pixel A.

It is to be noted that the division subfields may be arranged so that the subfields as a source of the division, each divided into the division subfields next to each other, are equal to each other. For example, as illustrated in Part (A) and Part (B) of FIG. 5, the division subfields SF4-1 and SF4-2 generated from the subfield SF4 are placed at the position of the subfield SF4. Further, for example, the division subfields SF5-1, SF5-2, SF5-3, and SF5-4 generated from the subfield SF5 are placed at the position of the subfield SF5, as illustrated in Part (A) and Part (B) of FIG. 5.

In this case, when gray-scale data with 32-level gray scale expressed by five bits (see FIG. 22) is inputted, for example, nine pieces of data in a 1:2:4:4:4:4:4:4:4 period ratio are prepared using, for example, data of one bit having a width of a few milliseconds, as a unit, as illustrated in FIG. 6, for instance. The 32-level gray scale is expressed by a combination of these nine pieces of data. Here, the fourth period and the fifth period from the lead correspond to the division subfields SF4-1 and SF4-2, respectively. In addition, the sixth period, the seventh period, the eighth period, and the ninth period from the lead correspond to the division subfields SF5-1, SF5-2, SF5-3, and SF5-4, respectively. In this gray-scale display method, the degree to which the border between black and white stays for a long time is equal to that in the gray-scale display method illustrated in FIG. 22. In the gray-scale display method of FIG. 6 however, the division subfield is applied on the high gray-scale side. Therefore, the degree to which the border between black and white stays for a long time is reduced to be lower than that in the gray-scale display method illustrated in FIG. 22, by performing rearrangement which will be described below.

The subfields and the division subfields in 1F are rearranged according to a predetermined rule. Specifically, when the phase of each bit of gray-scale data corresponding to one of the two pixels 11 next to each other is different from that corresponding to the other of the pixels 11, the bit array of the gray-scale data corresponding to the one of the pixels 11 is corrected to become closer to that corresponding to the other, while maintaining the gray-scale.

For example, suppose signal data is defined in an order of SF1, SF2, SF3, SF4-1, SF4-2, SF5-1, SF5-2, SF5-3, and SF5-4, sequentially from the lead, as illustrated in Part (A) of FIG. 7. Further, suppose, when the gray-scale corresponding to the pixel A is 15 and the gray-scale corresponding to the pixel B next to the pixel A is 16, the gray-scale data corresponding to each of the pixel A and the pixel B is defined according to the gray-scale display method of FIG. 6. In this case, in each of the subfields SF3, SF4-1, SF4-2, SF5-1, SF5-2, and SF5-3, the phase (black or white phase) of the bit of the pixel A is different from that of the pixel B. Specifically, in each of the subfields SF3, SF4-1, and SF4-2, the bit of the pixel A is 1 (white), while the bit of the pixel B is 0 (black). Further, in each of the subfields SF5-1, SF5-2, and SF5-3, the bit of the pixel A is 0 (black), while the bit of the pixel B is 1 (white).

In this way, when the phase of each bit of the gray-scale data corresponding to the one of the two pixels 11 next to each other is different from that corresponding to the other, the bit array of the gray-scale data corresponding to the pixel A is corrected to become closer to that corresponding to the pixel B. For example, as illustrated in Part (B) of FIG. 7, the bits corresponding to the respective subfields SF5-1, SF5-2, and SF5-3 are replaced with the bits corresponding to the respective subfields SF3, SF4-1, and SF4-2, respectively, in the bit array of the gray-scale data corresponding to the pixel A. The subfields SF5-1, SF5-2, and SF5-3 have the same periods as those of the subfields SF3, SF4-1, and SF4-2, respectively. Thus, in each of the subfields SF3, SF4-1, SF4-2, SF5-1, SF5-2, and SF5-3, the phase (black or white phase) of the bit in the pixel A and that in the pixel B become equal to each other. As a result, since the bit array of the gray-scale data corresponding to the pixel A is allowed to become closer to the bit array of the gray-scale data corresponding to the pixel B while maintaining the gray-scale of the pixel A, a liquid crystal disorder is reduced.

Next, there will be described a simple way of correcting a bit array of gray-scale data inputted from outside, to make this bit array become a bit array exemplified by those in Part (B) of FIG. 4 and Part (B) of FIG. 7. FIG. 8 is a flowchart illustrating a procedure of correcting a bit array of gray-scale data inputted from outside, to make this bit array become a desired bit array. Part (A) to Part (C) of FIG. 9 illustrate an example of the correction, when there is an input of gray-scale data with gradation generated in a vertical direction. Part (A) to Part (C) of FIG. 10 schematically illustrate the gray-scale data in Part (A) to Part (C) of FIG. 9.

First, upon being inputted from outside, the gray-scale data is stored in a predetermined memory (S101). For example, as illustrated in Part (A) of FIG. 9 and Part (A) of FIG. 10, when gray-scale data with 32-level gray scale expressed by five bits is inputted from outside, the gray-scale data is stored in the predetermined memory. Next, the gray-scale data is read from the memory, and each subfield on the high-bit side of the gray-scale data is divided into division subfields each having the same period as that of the subfield on the low-bit side of the gray-scale data (S102). For example, as illustrated in Part (B) of FIG. 9 and Part (B) of FIG. 10, the subfield of the fourth bit in the gray-scale data is divided into the two division subfields each having the same period as that of the subfield of the third bit in the gray-scale data. Further, the subfield of the fifth bit in the gray-scale data is divided into the four division subfields each having the same period as that of the subfield of the third bit in the gray-scale data.

Next, the bits corresponding to the subfield and the division subfields having the longest period are rearranged so that 1 (white) and 1 (white), as well as 0 (black) and 0 (black), are placed next to each other, respectively (S103). For example, see Part (B) and Part (C) of FIG. 9, as well as Part (B) and Part (C) of FIG. 10. In these figures, the bits corresponding to SF3 to SF5-4, which are the subfield and the division subfields having the longest period in the gray-scale data after the division, are rearranged, so that 1s (whites) are gathered on the low-bit side, and 0s (blacks) are gathered on the high-bit side. It is to be noted that the bits corresponding to SF3 to SF5-4, which are the subfield and the division subfields having the longest period in the gray-scale data after the division, may be rearranged, so that 1s (whites) are gathered on the high-bit side, and 0s (blacks) are gathered on the low-bit side. This is illustrated in Part (B) and Part (C) of FIG. 11, as well as Part (B) and Part (C) of FIG. 12, for example.

As a result, for instance, as illustrated in Part (A) and Part (B) of FIG. 13, the bit array of the gray-scale data corresponding to the pixel B belonging to a line 17 is brought closer to the bit array of the gray-scale data corresponding to the pixel A belonging to a line 16 as well as next to the pixel B. Alternatively, for example, as illustrated in Part (A) and Part (B) of FIG. 14, the bit array of the gray-scale data corresponding to the pixel A belonging to the line 16 is brought closer to the bit array of the gray-scale data corresponding to the pixel B belonging to the line 17 as well as next to the pixel A.

(Peripheral Circuit 20)

Next, a configuration of the peripheral circuit 20 will be described. The peripheral circuit 20 includes, for example, a conversion circuit 30, a controller 40, a vertical drive circuit 50, and a horizontal drive circuit 60, as illustrated in FIG. 1.

The controller 40 generates control signals 40A, 40B, and 40C that control operation timing of the conversion circuit 30, the vertical drive circuit 50, and the horizontal drive circuit 60, based on a synchronization signal 20B supplied from a host unit not illustrated. Examples of the synchronization signal 20B include a vertical synchronizing signal, a horizontal synchronizing signal, and a dot clock signal. Examples of the control signals 40A, 40B, and 40C include a clock signal, a latch signal, a start of frame signal, and a subfield start signal.

The conversion circuit 30 includes, for example, a frame memory 31, a write circuit 32, a read circuit 33, and a decoder 34, as illustrated in FIG. 15. The frame memory 31 is a memory for image display, and has a memory capacity at least larger than the resolution of a display region 10A. The frame memory 31 is capable of storing, for example, a row address, a column address, and gray-scale data of each of the pixels 11 associated with the row address and the column address. The write circuit 32 generates a write address Wad of an image signal 20A by using the synchronization signal 20B, and outputs the generated write address Wad to the frame memory 31 synchronously with the synchronization signal 20B. The write address Wad includes, for example, the row address and the column address. The read circuit 33 generates a reading address Rad based on the control signal 40A, and outputs the generated reading address Rad to the frame memory 31. The decoder 34 outputs the gray-scale data outputted from the frame memory 31, as signal data 30A.

The vertical drive circuit 50 outputs a scanning pulse used to select each of the pixels 11 row by row. The scanning pulse is outputted to the scanning line WSL, based on a control signal 60A (which will be described later) inputted from the horizontal drive circuit 60, and address data identified by the control signal 40C. For instance, the vertical drive circuit 50 sequentially outputs a selection pulse to each of the scanning lines WSL, corresponding to sequential positions and periods of SF5-1, SF4-1, SF5-2, SF3, SF1, SF2, SF5-3, SF4-2, and SF5-4, as illustrated in Part (A) to Part (D) of FIG. 16. It is to be noted that the vertical drive circuit 50 may sequentially output a selection pulse to each of the scanning lines WSL, corresponding to the sequential positions and periods of SF1, SF2, SF3, SF4-1, SF4-2, SF5-1, SF5-2, SF5-3, and SF5-4, as illustrated in Part (A) to Part (D) of FIG. 17, for example.

The horizontal drive circuit 60 controls the ratio of the ON period or the OFF period to 1F stepwise, by turning on or off the electro-optical device of the pixel 11 based on the control signal 40B and the signal data 30A.

The horizontal drive circuit 60 divides the subfield on the high-bit side of the signal data 30A into the division subfields each having the same period as that of the subfield on the low-bit side of the signal data 30A (S102 of FIG. 8). When the gray-scale data with 32-level gray scale expressed by five bits (see (A) of FIG. 2) is inputted as the signal data 30A, the horizontal drive circuit 60 divides each of the subfields SF4 and SF5 corresponding to the fourth bit and the fifth bit of the gray-scale data, respectively. Here, each of the subfields SF4 and SF5 is divided into periods that are each equal to the period of the subfield SF3, as illustrated in Part (B) of FIG. 2, for example. The period of the subfield SF3 is relatively shorter than that of the subfield SF4. As a result, the two division subfields SF4-1 and SF4-2 are generated from the subfield SF4, and the four division subfields SF5-1, SF5-2, SF5-3, and SF5-4 are generated from the subfield SF5.

Next, the horizontal drive circuit 60 places at least a part of (each of one or more of) the division subfields in a section different from that before the division, in the one frame period. Further, the horizontal drive circuit 60 places each of the division subfields, so that the subfields as a source of the division, each divided into the division subfields next to each other, are different from each other. Specifically, for example, the horizontal drive circuit 60 places the subfields SF1, SF2, and SF3 as well as the division subfields SF4-1, SF4-2, SF5-1, SF5-2, SF5-3, and SF5-4, in an order of SF5-1, SF4-1, SF5-2, SF3, SF1, SF2, SF5-3, SF4-2, and SF5-4 as illustrated in Part (B) of FIG. 2.

At this moment, it is preferable that the horizontal drive circuit 60 place a part of the division subfields at a position closer to the beginning of the one frame period. For example, as illustrated in Part (B) of FIG. 2, the horizontal drive circuit 60 places the division subfield SF5-1 at the lead of the one frame period (signal data). Further, for instance, the horizontal drive circuit 60 places the division subfield SF4-1 in the position second from the lead of the one frame period (signal data), as illustrated in Part (B) of FIG. 2.

The horizontal drive circuit 60 rearranges the subfields and the division subfields in 1F according to a predetermined rule (S103 of FIG. 8). Specifically, when the bit arrays of the gray-scale data, which correspond to the respective two pixels 11 next to each other, are different from each other, the horizontal drive circuit 60 performs the following correction. That is, the horizontal drive circuit 60 corrects the bit array of the gray-scale data corresponding to one of the two pixels 11, to bring this bit array closer to the bit array of the gray-scale data corresponding to the other of the two pixels 11, while maintaining the gray-scale.

The horizontal drive circuit 60 corrects the bit array of the gray-scale data corresponding to the pixel A, to bring this bit array closer to the bit array of the gray-scale data corresponding to the pixel B, as illustrated in Part (A) and Part (B) of FIG. 4, for example. For instance, the horizontal drive circuit 60 replaces the bit corresponding to the subfield SF4-1 and the bit corresponding to the subfield SF3 with each other, in the bit array of the gray-scale data corresponding to the pixel A, as illustrated in Part (A) and Part (B) of FIG. 4. The bit corresponding to the subfield SF3 has the same period as that of the subfield SF4-1. Thus, in each of the subfields SF4-1 and SF3, the pixel A and the pixel B become equal to each other, in terms of the phase (black or white phase) of the bit. As a result, the bit array of the gray-scale data corresponding to the pixel A is allowed to become closer to the bit array of the gray-scale data corresponding to the pixel B, while maintaining the gray-scale of the pixel A.

The horizontal drive circuit 60 may correct the bit array of the gray-scale data corresponding to the pixel A to bring this bit array closer to the bit array of the gray-scale data corresponding to the pixel B, as illustrated in Part (A) and (B) of FIG. 7, for example. For instance, the horizontal drive circuit 60 may replace the bits corresponding to the respective subfields SF3, SF4-1, and SF4-2 with the bits corresponding to the subfields SF5-1, SF5-2, and SF5-3, respectively, in the bit array of the gray-scale data corresponding to the pixel A, as illustrated in Part (A) and (B) of FIG. 7. The subfields SF5-1, SF5-2, and SF5-3 have the same periods as those of the subfield SF3, SF4-1, and SF4-2, respectively. Thus, in each of the subfields SF3, SF4-1, SF4-2, SF5-1, SF5-2, and SF5-3, the pixel A and the pixel B become equal to each other, in terms of the phase (black or white phase) of the bit. As a result, the bit array of the gray-scale data corresponding to the pixel A is allowed to become closer to the bit array of the gray-scale data corresponding to the pixel B, while maintaining the gray-scale of the pixel A.

It is to be noted that the horizontal drive circuit 60 may correct the bit array of the signal data 30A, to bring this bit array closer to a bit array exemplified by those in Part (B) of FIG. 4 and Part (B) of FIG. 7, in the following manner. Specifically, when the signal data 30A is inputted from outside, the horizontal drive circuit 60 stores the signal data 30A in the predetermined memory (S101 of FIG. 8). For example, when the gray-scale data with 32-level gray scale expressed by five bits is inputted from outside as the signal data 30A, the horizontal drive circuit 60 stores the signal data 30A in the predetermined memory, as illustrated in Part (A) of FIG. 9 and Part (A) of FIG. 10. Next, at predetermined timing, the horizontal drive circuit 60 reads the signal data 30A from the memory. The horizontal drive circuit 60 then divides the subfield on the high-bit side of the signal data 30A, into the division subfields each having the same period as that of the subfield on the low-bit side of the signal data 30A (S102 of FIG. 8). For example, the horizontal drive circuit 60 divides the subfield of the fourth bit in the signal data 30A into the two division subfields each having the same period as that of the subfield of the third bit in the signal data 30A, as illustrated in Part (B) of FIG. 9 and Part (B) of FIG. 10. Further, the horizontal drive circuit 60 divides the subfield of the fifth bit in the signal data 30A into the four division subfields each having the same period as that of the subfield of the third bit in the signal data 30A.

Next, the horizontal drive circuit 60 rearranges the bits corresponding to the subfield and the division subfields having the longest period, so that 1 (white) and 1 (white) as well as 0 (black) and 0 (black) are placed next to each other, respectively (S103 of FIG. 8). For example, the horizontal drive circuit 60 rearranges the bits corresponding to SF3 to SF5-4, which are the subfield and the division subfields having the longest period, in the signal data 30A after the division, as illustrated in Part (B) and Part (C) of FIG. 9, as well as Part (B) and Part (C) of FIG. 10. Thus, 1s (whites) are gathered on the low-bit side, whereas 0s (blacks) are gathered on the high-bit side. It is to be noted that the horizontal drive circuit 60 may rearrange the bits corresponding to SF3 to SF5-4, which are the subfield and the division subfields having the longest period, in the signal data 30A after the division, as illustrated in Part (B) and Part (C) of FIG. 11, as well as Part (B) and Part (C) of FIG. 12. Thus, 1s (whites) are gathered on the high-bit side, whereas 0s (blacks) are gathered on the low-bit side.

As a result, for instance, as illustrated in Part (A) and Part (B) of FIG. 13, the bit array of the signal data 30A corresponding to the pixel B belonging to the line 17 is brought closer to the bit array of the signal data 30A corresponding to the pixel A belonging to the line 16 as well as next to the pixel B. Alternatively, for example, as illustrated in Part (A) and Part (B) of FIG. 14, the bit array of the signal data 30A corresponding to the pixel A belonging to the line 16 is brought closer to the bit array of the signal data 30A corresponding to the pixel B belonging to the line 17 as well as next to the pixel A.

The horizontal drive circuit 60 outputs the signal data 30A after the correction, to each of the data lines DTL, corresponding to the sequential positions and the periods of the subfields and the division subfields of the signal data 30A after the correction. For example, the horizontal drive circuit 60 outputs the signal data 30A after the correction, to each of the data lines DTL, corresponding to the sequential positions and the periods of SF5-1, SF4-1, SF5-2, SF3, SF1, SF2, SF5-3, SF4-2, and SF5-4, as illustrated in Part (A) of FIG. 16. It is to be noted that, for instance, the horizontal drive circuit 60 may output the signal data 30A after the correction, to each of the data lines DTL, corresponding to the sequential positions and the periods of SF1, SF2, SF3, SF4-1, SF4-2, SF5-1, SF5-2, SF5-3, and SF5-4, as illustrated in Part (A) of FIG. 17.

Further, the horizontal drive circuit 60 outputs the control signal 60A to the vertical drive circuit 50, corresponding to the sequential positions and the periods of the subfields and the division subfields of the signal data 30A after the correction.

Effects

Now, effects of the display 1 of the present embodiment will be described, by making a comparison with digital driving according to a comparative example.

In PWM-digital driving, for instance, a gray-scale display method like the one illustrated in FIG. 22 according to a comparative example may be used when a case of five bits (32-level gray scale) is taken as an example. Specifically, as illustrated in FIG. 22, for instance, five pieces of data in a 1:2:4:8:16 period ratio are prepared, using data of one bit having a width of a few milliseconds as a unit, for instance, and the 32-level gray scale is expressed by a combination of these five pieces of data.

Part (A) to Part (D) of FIG. 23 illustrate a relationship between signal data in sequential scanning and selection pulses applied to scanning lines, in the typical digital driving according to a comparative example. Here, a case of using the three scanning lines is illustrated for the sake of description. As apparent from Part (A) to Part (D) of FIG. 23, in a display of the typical digital driving, one frame period (1F) is divided into subfields SF1 to SF5 corresponding to the respective bits (in this case, the first bit to the fifth bit) of gray-scale data. The subfields SF1 to SF5 are periods each depending on the weight of the corresponding bit. The ratio of an ON period or an OFF period to the 1F is controlled stepwise, by turning an electro-optical device of a pixel on or off in accordance with the bit corresponding to each of the subfields SF1 to SF5. Further, writing data to the pixel through the scanning line is performed in line-sequential scanning for each of the subfields SF1 to SF5.

Meanwhile, as illustrated in FIG. 22 according to a comparative example, when there is used a gray-scale display method in which a black/white-phase inversion occurs due to a slight difference in gray-scale, a liquid crystal disorder may take place between pixels next to each other because of a transverse electric field. For example, as illustrated in Part (A) and Part (B) of FIG. 24, when an image having gradation in a vertical direction (which will be hereinafter simply referred to as "gradation image") is displayed, a liquid crystal disorder occurs between pixels each having an inverted black or white phase. This liquid crystal disorder is visually recognized by a viewer, as a black streak L1 illustrated in Part (B) of FIG. 24, for example. This black streak L1 significantly impairs image quality.

In the present embodiment, in contrast, the "division subfield" is applied to the subfield having a relatively long period (i.e. on the high gray-scale side), as a unit of the lighted period or the extinguished period of the pixel 11. In other words, each of one or more of the subfields each having a relatively long period is divided into the periods each equal to the period of the subfield having a relatively short period. Further, when the bit arrays of gray-scale data corresponding to the two pixels 11 next to each other are different, the bit array of the gray-scale data corresponding to one of the two pixels 11 is corrected to become closer to the bit array of the gray-scale data corresponding to the other of the two pixels 11, while maintaining the gray-scale. This allows a reduction in the ratio of a place where the bit arrays of gray-scale data corresponding to the two pixels 11 next to each other are different from each other, which allows the liquid crystal disorder to be less likely to occur. As a result, achievement of high image quality is allowed.

2. MODIFICATIONS

Modification 1

Meanwhile, in some cases, a part where phases are still different remains, even after the bit array of the gray-scale data corresponding to the one of the two pixels 11 is corrected to be closer to the bit array of the gray-scale data corresponding to the other of the two pixels 11 while maintaining the gray-scale as described above. Part (A) of FIG. 18 is equivalent to Part (B) of FIG. 4, and indicates a dashed line surrounding the above-mentioned part where the phases are still different remains after the correction. Part (B) of FIG. 18 is equivalent to Part (B) of FIG. 7, and indicates a dashed line surrounding the above-mentioned part where the phases are still different remains after the correction. In some cases, when the part with the different phases remains as illustrated in each of Part (A) and Part (B) of FIG. 18, the liquid crystal disorder may occur to the extent of being visually recognized, depending on the remaining amount thereof. In that case, gray-scale data with higher gray-scale is corrected as necessary to have higher gray-scale. For instance, in the example illustrated in Part (C) of FIG. 18, the pixel B is higher in gray-scale than the pixel A and therefore, the gray-scale data corresponding to the pixel B is corrected to have higher gray-scale. This reduces the liquid crystal disorder, thereby allowing high image quality to be achieved.

Next, a specific example of the foregoing additional correction will be described. FIG. 19 is a flowchart illustrating a procedure, in which the bit array of the signal data 30A (which will be hereinafter simply referred to as the "signal data 30A") after being already corrected in the embodiment is further corrected to be a desired bit array. Part (A) to Part (C) of FIG. 20 illustrate an example of the additional correction, when the signal data 30A is gray-scale data in which gradation is generated in a vertical direction.

First, the horizontal drive circuit 60 detects the presence or absence of a phase difference in gray-scale data between two pixels next to each other in the signal data 30A, for every subfield and division subfield common to the two pixels (S201). Here, the phase difference refers to a difference in bit or a difference in black and white. When detecting the absence of the phase difference, the horizontal drive circuit 60 ends operation without making the additional correction. When detecting the presence of the phase difference, on the other hand, the horizontal drive circuit 60 creates a correction value for the gray-scale data with higher gray-scale, as illustrated in Part (A) of FIG. 20, for example (S202). For instance, as illustrated in Part (B) of FIG. 20, the horizontal drive circuit 60 creates gray-scale data with a gray-scale level of 1, as the correction value. It is to be noted that the correction value is not necessarily the gray-scale data with the gray-scale level of 1. The horizontal drive circuit 60 then corrects the gray-scale of the gray-scale data with higher gray-scale (S203). For example, the horizontal drive circuit 60 adds the gray-scale data with the gray-scale level of 1 to the gray-scale data with higher gray-scale, as illustrated in Part (C) of FIG. 20. As a result, the gray-scale data with higher gray-scale is corrected to have higher gray-scale. This reduces the liquid crystal disorder or increases the gray-scale of the pixel with higher gray-scale to thereby offset a decline in luminance of the liquid crystal disorder, which makes the liquid crystal disorder less easy to recognize. Therefore, high image quality is allowed to be achieved.

Modification 2

In the embodiment or the modification 1, the horizontal drive circuit 60 may add the correction value common to all the pixels to the signal data 30A corresponding to all the pixels, and periodically change the correction value, for every frame. For example, as illustrated in Part (A) to Part (C) of FIG. 21, the horizontal drive circuit 60 may sequentially repeat and add the followings to the signal data 30A corresponding to all the pixels, for every frame.

+100000000 (gray-scale data raising the gray-scale level by +1)

+100000000 (gray-scale data raising the gray-scale level by +1)

−010000000 (gray-scale data lowering the gray-scale level by −3)

+100000000 (gray-scale data raising the gray-scale level by +1)

In this case, the streak L1 generated by the liquid crystal disorder oscillates with predetermined amplitude over time within an image display surface, as illustrated in Part (C) of FIG. 21, making it difficult for a viewer to visually recognize the streak L1. This allows achievement of high image quality.

The technology has been described using the example embodiment and the modifications, but is not limited thereto and may be variously modified.

For example, in the example embodiments and the modifications, driving of the conversion circuit 30, the vertical drive circuit 50, and the horizontal drive circuit 60 is controlled by the controller 40. However, this driving may be controlled by other circuit. In addition, the control of the conversion circuit 30, the vertical drive circuit 50, and the horizontal drive circuit 60 may be performed with hardware (a circuit) or software (a program).

Accordingly, it is possible to achieve at least the following configurations from the above-described example embodiments and the modifications of the disclosure.

(1) A drive circuit driving each of pixels that are arranged in matrix in a display, each of the pixels being provided with a built-in memory that includes a liquid crystal cell, the drive circuit including:

a division section dividing one frame period into a plurality of subfields, and dividing each of one or more of the plurality of subfields to generate a plurality of division subfields, each of the plurality of subfields corresponding to each bit of gray-scale data and having a period corresponding to a weight of the corresponding bit, and each of the one or more of the plurality of subfields having the period that is relatively long and being divided into periods each equal to the period of the subfield that is relatively short;

a correction section correcting, when bit arrays of the gray-scale data corresponding to the respective two pixels next to each other are different from one another, the bit array of the gray-scale data corresponding to a first pixel of the two pixels to bring this bit array closer to the bit array of the gray-scale data corresponding to a second pixel of the two pixels, while maintaining gray-scale; and an ON-OFF-period control section controlling a ratio of an ON period or an OFF period to the one frame period, by turning on or off the liquid crystal cell of each of the pixels according to the bit corresponding to each of the subfields and each of the division subfields.

(2) The drive circuit according to (1), wherein, when the bit arrays of the respective two pixels are still different even after the bit array of the gray-scale data corresponding to the first pixel is brought closer to the bit array of the gray-scale data corresponding to the second pixel while the gray-scale is maintained, the correction section corrects one of the gray-scale data of the respective two pixels that has the higher gray-scale to be increased.

(3) The drive circuit according to (1) or (2), wherein the correction section adds a correction value common to all the pixels to the gray-scale data corresponding to each of all the pixels and periodically changes the correction value for every frame.

(4) A display with a display region and a drive circuit, the display region being provided with pixels that are arranged in matrix and each having a built-in memory that includes a liquid crystal cell, and the drive circuit driving each of the pixels, the drive circuit including:

a division section dividing one frame period into a plurality of subfields, and dividing each of one or more of the plurality of subfields to generate a plurality of division subfields, each of the plurality of subfields corresponding to each bit of gray-scale data and having a period corresponding to a weight of the corresponding bit, and each of the one or more of the plurality of subfields having the period that is relatively long and being divided into periods each equal to the period of the subfield that is relatively short;

a correction section correcting, when bit arrays of the gray-scale data corresponding to the respective two pixels next to each other are different from one another, the bit array of the gray-scale data corresponding to a first pixel of the two pixels to bring this bit array closer to the bit array of the gray-scale data corresponding to a second pixel of the two pixels, while maintaining gray-scale; and an ON-OFF-period control section controlling a ratio of an ON period or an OFF period to the one frame period, by turning on or off the liquid crystal cell of each of the pixels according to the bit corresponding to each of the subfields and each of the division subfields.

(5) A method of driving a display, the display being provided with pixels that are arranged in matrix and each having a built-in memory that includes a liquid crystal cell, the method including:

dividing one frame period into a plurality of subfields, and dividing each of one or more of the plurality of subfields to generate a plurality of division subfields, each of the plurality of subfields corresponding to each bit of gray-scale data and having a period corresponding to a weight of the corresponding bit, and each of the one or more of the plurality of subfields having the period that is relatively long and being divided into periods each equal to the period of the subfield that is relatively short;

correcting, when bit arrays of the gray-scale data corresponding to the respective two pixels next to each other are different from one another, the bit array of the gray-scale data corresponding to a first pixel of the two pixels to bring this bit array closer to the bit array of the gray-scale data corresponding to a second pixel of the two pixels, while maintaining gray-scale; and controlling a ratio of an ON period or an OFF period to the one frame period, by turning on or off the liquid crystal cell of each of the pixels according to the bit corresponding to each of the subfields and each of the division subfields.

The disclosure contains subject matter related to that disclosed in Japanese Priority Patent Application JP 2011-189928 filed in the Japan Patent Office on Aug. 31, 2011, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A drive circuit driving each of pixels that are arranged in matrix in a display, each of the pixels being provided with a built-in memory that includes a liquid crystal cell, the drive circuit comprising:

a division section configured to divide one frame period into a plurality of subfields, and to respectively divide one or more of the plurality of subfields to generate a plurality of division subfields, respective ones of the plurality of subfields corresponding to a respective bit of gray-scale data and having a period corresponding to a weight of the corresponding bit, and respective ones of the one or more of the plurality of subfields which have a period that is relatively long are divided into periods each equal to the period of a subfield which has a period that is relatively short;

a correction section configured to rearrange, when bit arrays of the gray-scale data respectively corresponding to two adjacent pixels that are different from one another, the bit array of the gray-scale data corresponding to a first pixel of the two adjacent pixels to bring the first pixel bit array closer to the bit array of the gray-scale data corresponding to a second pixel of the two adjacent pixels, while maintaining the respective gray-scale levels of the first and second pixels; and an ON-OFF-period control section configured to control a ratio of an ON period or an OFF period to the one frame period, by turning on or off the liquid crystal cell of each of the pixels according to the bit corresponding to each of the subfields and each of the division subfields.

2. The drive circuit according to claim 1, wherein, when the bit arrays of the two adjacent pixels are still different even after the bit array of the gray-scale data corresponding to the first pixel is brought closer to the bit array of the gray-scale data corresponding to the second pixel while the respective gray-scale levels are maintained, the correction section is further configured to increase the gray-scale level of the pixel of the two adjacent pixels that has the higher gray-scale.

3. The drive circuit according to claim 1, wherein the correction section is further configured to add a correction value common to all the pixels to the gray-scale data corresponding to each of all the pixels and periodically to change the correction value for every frame.

4. The drive circuit according to claim 1, wherein a gray-scale level of the first pixel is higher than a gray-scale level of the second pixel.

5. The drive circuit according to claim 1, wherein a gray-scale level of the second pixel is higher than a gray-scale level of the first pixel.

6. A display with a display region and a drive circuit, the display region being provided with pixels that are arranged in matrix and each having a built-in memory that includes a liquid crystal cell, and the drive circuit driving each of the pixels, the drive circuit comprising:

a division section configured to divide one frame period into a plurality of subfields, and to respectively divide one or more of the plurality of subfields to generate a plurality of division subfields, respective ones of the plurality of subfields corresponding to a respective bit of gray-scale data and having a period corresponding to a weight of the corresponding bit, and respective ones of the one or more of the plurality of subfields which have a period that is relatively long are divided into periods each equal to the period of a subfield which has a period that is relatively short;

a correction section configured to rearrange, when bit arrays of the gray-scale data respectively corresponding to two adjacent pixels that are different from one another, the bit array of the gray-scale data corresponding to a first pixel of the two adjacent pixels to bring the first pixel bit array closer to the bit array of the gray-scale data corresponding to a second pixel of the two adjacent pixels, while maintaining the respective gray-scale levels of the first and second pixels; and an ON-OFF-period control section configured to control a ratio of an ON period or an OFF period to the one frame period, by turning on or off the liquid crystal cell of each of the pixels according to the bit corresponding to each of the subfields and each of the division subfields.

7. The display according to claim 6, wherein, when the bit arrays of the two adjacent pixels are still different even after the bit array of the gray-scale data corresponding to the first pixel is brought closer to the bit array of the gray-scale data corresponding to the second pixel while the respective gray-scale levels are maintained, the correction section is further configured to increase the gray-scale level of the pixel of the two adjacent pixels that has the higher gray-scale.

8. The display according to claim 6, wherein the correction section is further configured to add a correction value common to all the pixels to the gray-scale data corresponding to each of all the pixels and periodically to change the correction value for every frame.

9. A method of driving a display, the display being provided with pixels that are arranged in matrix and each having a built-in memory that includes a liquid crystal cell, the method comprising:

dividing one frame period into a plurality of subfields, and respectively dividing one or more of the plurality of subfields to generate a plurality of division subfields, respective ones of the plurality of subfields corresponding to a respective bit of gray-scale data and having a period corresponding to a weight of the corresponding bit, and respective ones of the one or more of the plurality of subfields which have a period that is relatively long are divided into periods each equal to the period of a subfield which has a period that is relatively short;

rearranging, when bit arrays of the gray-scale data respectively corresponding to two adjacent pixels that are different from one another, the bit array of the gray-scale data corresponding to a first pixel of the two adjacent pixels to bring the first pixel bit array closer to the bit array of the gray-scale data corresponding to a second pixel of the two adjacent pixels, while maintaining the respective gray-scale levels of the first and second pixels; and controlling a ratio of an ON period or an OFF period to the one frame period, by turning on or off the liquid crystal cell of each of the pixels according to the bit corresponding to each of the subfields and each of the division subfields.

10. The method according to claim 9, wherein a gray-scale level of the first pixel is higher than a gray-scale level of the second pixel.

11. The method according to claim 9, wherein a gray-scale level of the second pixel is higher than a gray-scale level of the first pixel.

12. The method according to claim 9, further comprising:

increasing the gray-scale level of the pixel of the two adjacent pixels that has the higher gray-scale when the bit arrays of the two adjacent pixels are still different even after the bit array of the gray-scale data corresponding to the first pixel is brought closer to the bit array of the gray-scale data corresponding to the second pixel while the respective gray-scale levels are maintained.

13. The method according to claim 9, further comprising:

adding a correction value common to all the pixels to the gray-scale data corresponding to each of all the pixels and periodically to change the correction value for every frame.

14. The method according to claim 9, wherein a gray-scale level of the first pixel is higher than a gray-scale level of the second pixel.

15. The method according to claim 9, wherein a gray-scale level of the second pixel is higher than a gray-scale level of the first pixel.

* * * * *